United States Patent [19]

Grohowski et al.

[11] 4,133,035

[45] Jan. 2, 1979

[54] SELECTABLE COILING CONTROL METHOD AND APPARATUS

[75] Inventors: Joseph A. Grohowski; Tom L. Galanis, both of Bethlehem, Pa.

[73] Assignee: Bethlehem Steel Corporation, Bethlehem, Pa.

[21] Appl. No.: 825,118

[22] Filed: Aug. 16, 1977

[51] Int. Cl.[2] ..... G06F 15/46; B21C 47/28

[52] U.S. Cl. ..... 364/472; 72/138; 242/83; 364/110; 364/469

[58] Field of Search ..... 364/472, 468, 469, 478, 364/110, 118, 300; 235/92 DN, 92 CW; 242/75.5, 75.51, 82, 83; 72/7, 8, 11, 138; 444/1

[56] References Cited

U.S. PATENT DOCUMENTS

| | | | |
|---|---|---|---|
| 3,337,154 | 8/1967 | Smith, Jr. et al. | 242/83 |
| 3,663,806 | 5/1972 | Drankhan et al. | 364/472 |
| 3,666,196 | 5/1972 | Fullers et al. | 242/82 |
| 3,822,045 | 7/1974 | Johnson | 242/83 |
| 3,873,040 | 3/1975 | Sieurin et al. | 242/83 |
| 4,052,599 | 10/1977 | Whiteley et al. | 242/75.51 |

*Primary Examiner*—Charles E. Atkinson
*Assistant Examiner*—Errol A. Krass
*Attorney, Agent, or Firm*—Joseph J. O'Keefe; John I. Iverson; George G. Dower

[57] ABSTRACT

Computerized coiling control in which both pouring reel location and reel speed wobble pattern are preselected, whereby a moving product, such as bar, rod or wire, is continuously poured into a reel to form the densest product coils under a variety of coiling situations. A coiler operator presets independently adjustable parameters including coil O.D. and I.D., reel speed wobble rate, and a reel speed wobble pattern selected from computer storage and having either a spiral, spiral with dwell, or triangular waveform. The computer is programmed to assimilate operator input data, and calculate reel motor speed reference and current reference signals for use by a reel motor controller which will form the densest coils having predetermined flat spirals stacked axially in alternate reverse-convolute layers. Reel speed is modified to compensate coiler operation for effects due to variations in bar grade, temperature and/or shape.

31 Claims, 26 Drawing Figures

1 ST LAYER
SEGMENT "A"-SPIRAL,
SEGMENT "B" = 0

2 ND LAYER
SEGMENT "C"-SPIRAL
SEGMENT "D" = 0

1 ST LAYER
SEGMENT "A"-SPIRAL
SEGMENT "B"-DWELL

2 ND LAYER
SEGMENT "C"-SPIRAL
SEGMENT "D"-DWELL

1 ST LAYER
SEGMENT "A-TRIANGULAR
SEGMENT "B" = 0

2 ND LAYER
SEGMENT "C"-TRIANGULAR
SEGMENT "D" = 0

SELECTABLE COILING CONTROL METHOD AND APPARATUS

BACKGROUND OF THE INVENTION

Field of the Invention

This invention relates broadly to reeling control methods and apparatus. More particularly, this invention relates to a coiling control method and apparatus having selectable reel and/or reel speed functions for facilitating the pouring of a moving product into a coiling reel under a variety of coiling situations. The product may be made in a bar, merchant, rod, tube or wire mill. The invention may also be applied to laying heads or laying cones associated with wire and rod mills. Hereinafter, the invention will be described with reference to a bar mill for illustrative purposes only.

DESCRIPTION OF THE PRIOR ART

During rolling of billets into bars, for example, a continuous flow of hot product moves from a rolling mill finishing stand into a coiling station where the moving product is guided into a pouring reel until a reel is full, or until the billet is depleted. Bars of various materials, grades or compositions may be rolled, at various speeds and temperatures and in predetermined cross-sectional shapes.

Bar shapes include round, square, hexagonal, flat, oval and other configurations. Bar speed for round steel product may range from about 1000 ft./min. (305 m./min.) for 2 inch diameter (5.1 cm.) bar to about 4000 ft./min. (1219 m./min.) for ½ to ⅞ inch diameter (1.27 to 2.22 cm.) bar. Larger and smaller size bars, as well as different bar materials and shapes, are rolled at correspondingly different speeds. Under normal operating conditions, steel bar is rolled at nearly a constant speed with a desired finishing temperature of about 1700° F. (930° C.). Regardless of what the desired operating conditions may be, changes occur in practice which vary bar temperature and speed. Thus, it will be seen that a vast range of bar coiling situations are present in contemporary mills which must be dealt with rapidly, efficiently and reliably.

Insofar as coiling of the hot moving product is concerned, it is highly desirable to guide the hot moving product into a rotating pouring reel by the use of coiling forces in such manner as to form a coil of product within the reel. The prior art teaches that a coil having high density may be achieved ideally by an Archimedes spiral, that is, a coil having flat spirals stacked axially in the reel in alternate reverse-convolute layers.

Coiling forces required at any instant to mechanically bend the hot moving product into a particular coil radius or layer within the pouring reel are relatively small. These forces must be precisely defined and controlled to minimize or eliminate coil deviating forces in order to achieve maximum coil density. Coiling forces vary for each coiling situation. They are also different for every different coiling situation presented by the various parameters noted above.

Heretofore, it was known only that coiling forces were related to bar linear speed, bar diameter and and pouring reel angular speed. Pouring reel speed was wobbled according to an Archimedes spiral pattern and, under ideal conditions, a coil of high density product was to have resulted. In practice, however, ideal conditions are seldom achieved. This is particularly true in contemporary high-speed steel bar rolling mills. Here it has been discovered that in addition to bar speed and conventional reel speed parameters, a number of other parameters must be considered throughout every coiling situation to define and control the reel speed for the coiling forces needed. These other parameters include: product cross-sectional dimension, coil O.D. and I.D., pouring reel wobble time or rate, wobble pattern characteristics, length and size of product on each coil layer, and whether or not product feed should be switched to another reel. Furthermore, reel speed must be modified to accommodate certain changes in bar grade, temperature and shape from initial values thereof in order to achieve or maintain maximum coil density.

One prior art installation relied on developing a pouring reel motor-generator drive system where the coiler reel drive motor was controlled by bar speed and a sinusoidal-dwell control voltage. Another prior art coiler speed controller included analog control components which generated a reel speed reference signal and torque program signal as a function of a bar speed signal divided by a variable radius generator signal. The latter signal is continuously generated proportional to the desired coil radius (Archimedes spiral) of the product in the pouring reel. This arrangement has analog circuit limitations with regards to control performance and reliability.

Some of the commercially available coiler controls place the responsibility of setting up all coiling parameters upon the coiler operator. Others even require the operator to estimate bar speed in order to set pouring reel speeds properly. Generally, the coiler operator had to stop bar from going to a pouring reel that was not ready to receive products. None of the prior art pouring reel control systems is adapted to act on any of the above-mentioned additional parameters required for pouring reel speed control in contemporary rolling mills. This is particularly true with regard to changing reel speed wobble patterns to fit various coiling situations.

SUMMARY OF THE INVENTION

A main object of this invention is to provide an improved coiling control method and apparatus that will overcome the foregoing difficulties.

One other object of this invention is to provide an improved coiling control method and apparatus which will accommodate a variety of product coiling situations, yet handle them rapidly, efficiently and reliably.

Another object of this invention is to provide an improved coiling control method and apparatus which will relieve a coiler operator of setup problems.

Another object of this invention is to provide an improved coiling control method and apparatus which is easy to change coiler reel speed wobble patterns to fit a variety of coiling situations.

Still another object of this invention is to provide an improved coiling control method and apparatus which changes a parameter in determining a coiler reel speed wobble pattern in response to a change in coiling product dimension, a coil dimension, or wobble time or rate.

Yet another object of this invention is to provide an improved coiling control method and apparatus which modifies coiler reel speed to compensate for variations from standard coiling product speed, material, grade, temperature, or cross-sectional shape.

A final object of this invention is to provide an improved coiling control method and apparatus which detects the operative condition of a plurality of coiling reels and switches product overflow from an operating coiling reel to an operable coiling reel.

The foregoing objects may advantageously be achieved by using a selectable coiling control method and apparatus which, under a programmed digital computer supervision, preselects pouring reel location, generates a pouring reel speed reference signal and a reel motor current reference signal, both of which control reel motor speed and torque, whereby a moving product such as bar, rod or wire is continuously poured into the reel to form the densest product coils under a variety of coiling situations. The computer is programmed to assimilate bar dimension and bar speed signals from a bar mill making the product; calculate a corrected bar speed and bar length signals; assimilate preset parameters from a coiler operator panel including independently variable coil O.D. and I.D., reel speed wobble time or rate, and a reel speed wobble pattern selection from computer storage having either a spiral, spiral with dwell, or triangular four-segment waveform, and calculate total inertia of pouring reel and coil. The computer is adapted to generate the reel speed reference signal and current reference signal based on the foregoing parameters, and is further adapted to modify the reel speed reference signal to compensate coiler operation for effects due to variations in product grade, temperature and/or shape.

DESCRIPTION OF THE PREFERRED EMBODIMENT

Figure 1:
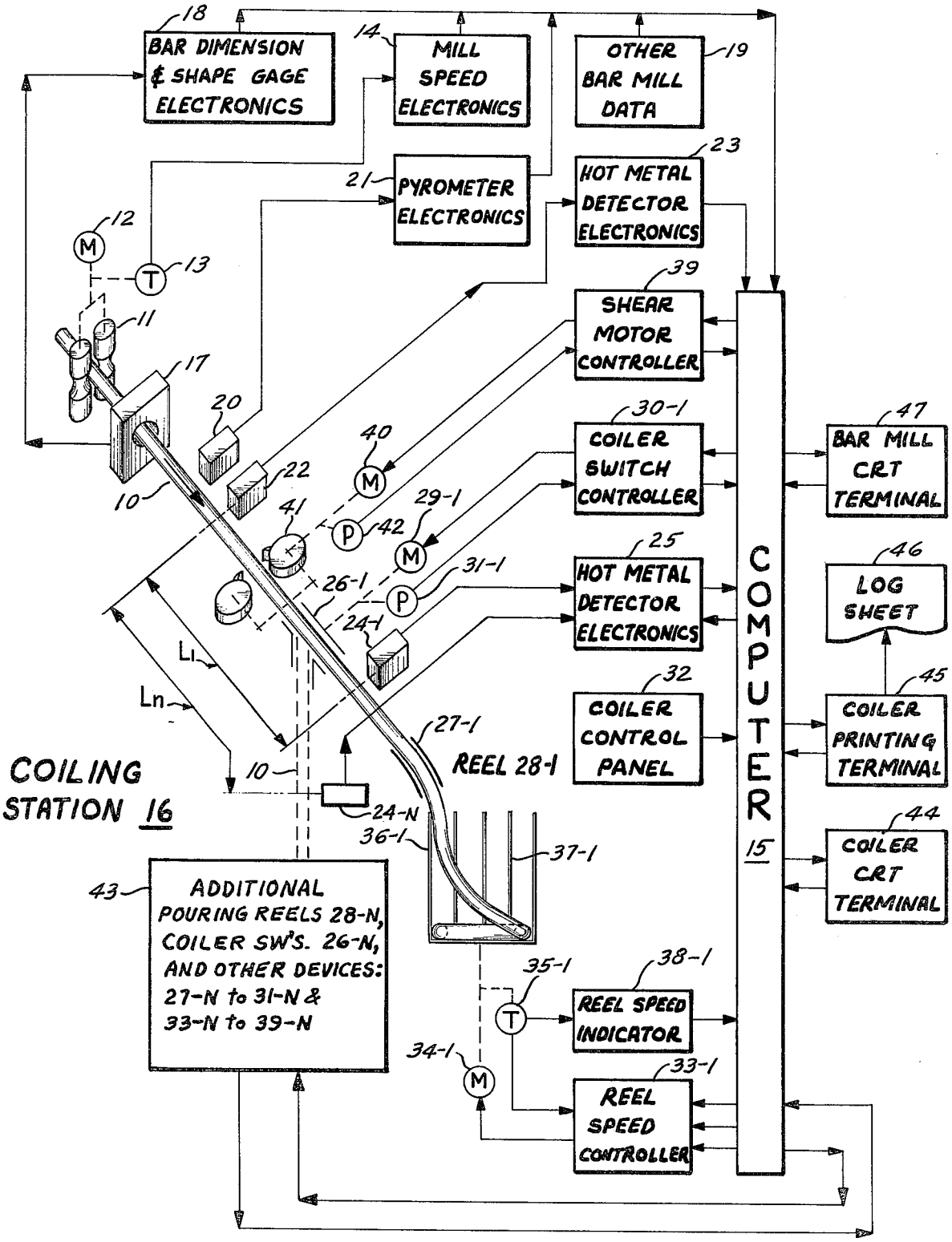
FIG. 1 is a block diagram of an overall computerized, selectable, coiling control apparatus illustrative of the present invention.

Referring now to the drawings, particularly FIG. 1, there is shown a computerized coiling control system having selectable coiler reels and selectable reel speed wobble patterns in the environment of a hot steel bar rolling mill. Moving bar 10 exits from finishing stand 11 at a variable speed as determined by mill drive motor 12. Mill speed is sensed by a pulse type tachometer 13 which has a pulse output signal proportional to mill speed processed in mill speed electronics 14 to better define pulse waveform. Pulsed output from mill speed electronics 14 is fed to programmed digital computer 15 where it is corrected and converted to a calibrated bar speed signal and a bar length signal as described below.

As bar 10 moves toward coiling station 16 it passes through commercially available bar gage 17 where two signals are generated. A dimension signal is generated proportional to the lateral dimension of bar 10. A shape signal is generated relative to the lateral profile of bar 10. Both of these signals are processed in bar dimension and shape gage electronics 18, the output of which is also fed to computer 15 for use as described below.

As an alternative, the bar 10 dimension and shape signals may be provided from bar order information by other bar mill data source 19. Source 19 also provides bar 10 material and grade data signals, which together with the bar dimension and shape signals are fed to computer 15 for use as described below.

The finishing temperature of bar 10 is sensed by pyrometer 20 which sends a raw temperature signal to pyrometer electronics 21. Here the signal is first processed and linearized and then fed a linear temperature signal to computer 15 for use as described below.

The leading and trailing ends of hot bar 10 are first sensed by first hot metal detector 22 which sends a raw pulse to hot metal detector electronics 23. This pulse is processed in hot metal detector electronics 23 so that first leading and trailing end pulses are generated which correspond to the first presence and absence of hot bar 10 at a first location in coiling station 16. The leading and trailing ends of hot bar 10 are also sensed by a second hot metal detector 24-1 located a known distance $L_1$ from the first hot metal detector 22. This second detector also produces a raw pulse which is processed in hot metal detector electronics 25. Device 25 generates second leading and trailing end pulses which also correspond to the presence and absence of hot bar 10 at the second location in coiling station 16. The first and second leading and trailing end pulses are fed from hot metal detector electronics 23, 25 to computer 15 where, as explained below, they are used to calibrate the bar speed and bar length signals with reference to the known distance $L_1$. In addition, these first and second pulses are also used in computer 15 for pouring reel and shear control purposes as described below.

Coiling station 16 includes a number of coiler switches 26-1 to 26-N for selectively directing movement of hot bar 10 through one of coiler bar guides 27-1 to 27-N and an associated one of a plurality of pouring reels 28-1 to 28-N located in coiling station 16. Each of the pouring reels is located a different distance from first hot metal detector 22, therefore pouring reels 28-1 to 28-N require a second hot metal detector 24-2 to 24-N, each located a different known distance $L_n$ from detector 22. Each second hot metal detector 24-2 to 24-N is preselected by computer 15 to operate one at a time with hot metal detector electronics 25. In this manner, computer 15 makes a uniform correction of bar speed and bar length calculations, even though a different length standard $L_1$ to $L_n$ is associated with each pouring reel 28-1 to 28-N.

Selection of which pouring reel 28-1 to 28-N will receive moving bar 10 is carried out under control of a group of coilar switches 26-1 to 26-N. Each of these coiler switches is operated by a corresponding motor (or by solenoid valve) 29-1 to 29-N. Each motor is energized from a related coiler switch controller 30-1 to 30-N which, together with computer 15, receive coiler switch position feedback signals from corresponding position transmitters 31-1 to 31-N. Computer 15 feeds coiler switch control signals to controllers 30-1 to 30-N. These control signals are based on an automatic selection of one or more coiler switch sequential operations that are required to direct moving hot bar 10 to a predetermined pouring reel 28-1 to 28-N. Pouring reel 28-1 to 28-N selection and coiler switch 26-1 to 26-N selection may also be controlled from manually operated selector switches located in coiler control panel 32 described below.

In order to deal with the variety of coiling situations in high-speed bar mills, the coiling station operator must be free of doing any calculations before and during coiling operations, yet have the latitude to make adjustments in coiling parameters if such is desired. Therefore, not only are coiler switch and pouring reel selections made at coiler control panel 32, but so are the selections of numerous other setup and operating parameters, all of which are fed to computer 15. The following operating parameters are selected independently of each other and are duplicated on coiler control panel 32 for each pouring reel 28-1 to 28-N located in coiling station 16: (a) coil outside dimension (O.D.); (b) coil inside dimension (I.D.); (c) reel speed wobble time period, or rate; (d) reel speed wobble pattern generated in computer 15 and involving stored tabular data therein, the latter being exemplified in TABLE 1, Parts 1, 2, 3; (e) reel start request; (f) reel start wobble request; (g) reel stop wobble request; and (h) reel stop request. Parameters a, b, c and d, along with the bar speed, bar size, bar length, and optionally bar grade, temperature and shape parameters mentioned above, are used by computer 15 to calculate a variable reel speed reference signal and a variable motor current reference signal for every pouring reel 28-1 to 28-N selected to receive moving hot bar 10. The waveforms of variable reel speed and current reference signals are shown in FIGS. 5 to 11.

Still referring to FIG. 1, the reel speed reference signals, reel motor current reference signals, and the reel start and stop requests are all fed to respective reel speed controller 33-1 to 33-N. Each controller is a commercially available device circuited to vary the speed and regulate the torque of reel drive motors 34-1 to 34-N proportional to their respective variable reel speed and variable motor current reference signals fed from computer 15. Regulation of each controller 33-1 to 33-4 is adjusted so that a substantially zero error signal is always maintained between respective variable reel speed reference signals and corresponding reel speed feedback signals fed from reel speed tachometers 35-1 to 35-N. All reference signals are limit-checked in computer 15, as described below, so that reel speed variations during coiling of bar 10 will be maintained within limits related to bar speed and respective pouring reel tube outside diameter (O.D.) 36-1 to 36-N and inside diameter (I.D.) 37-1 to 37-N.

Actual speed of each coiling reel 28-1 to 28-N is read on corresponding reel speed indicators 38-1 to 38-N. These indicators sample the reel speed signals from corresponding tachometers 35-1 to 35-N and feed them to computer 15. The reel speed signals are used in computer 15 for display and logging purposes, as described below, but they are not used for the calculation of either the reel speed or motor current reference signals.

After the selected pouring reel 28-1 to 28-N is filled from bottom to a predetermined level with coiled bar 10, a shear cut signal is initiated and fed from computer 15 to shear motor controller 39. Controller 39 energizes shear motor 40 so that shear 41 will rotate one revolution and make a divide shear cut in bar 10. Shear 41 rotational position is determined by shear position transmitter 42 and fed back to computer 15 which in turn feeds control signal to shear motor controller 39 to ensure that only one revolution of shear 42 is made for a divide shear cut of bar 10 when hot metal detector 22 senses bar 10 exiting from finishing stand 11.

When a divide shear cut of bar 10 is made, or when the trailing end of bar 10 is sensed by hot metal detector 22, computer 15 scans ready-to-receive-product signals fed from all remaining pouring reels 28-2 to 28-N. Computer 15 decides on which of these pouring reels is the next available coiler and activates coiler switches 26-1 to 26-N to guide the new front of bar 10 into the selected pouring reel 28-2 to 28-N. Corresponding devices in block 43 are also energized and the above-described coiling procedure is repeated.

If no pouring reels are available, or all reels are incapacitated, computer 15 sends a cobble shear cut signal to shear motor controller 39 and motor 40 to continuously rotate shear 41, or an equivalent, so that bar 10 will be cut into pieces and disposed of rather than causing a bar cobble at the coiling area.

All operating signals fed to or from computer 15 may be called for and displayed on coiler CRT terminal 43, as well as duplicating coiler control panel 42 signals, when using predetermined mnemonics. Likewise, all these operating signals may be called for by coiler printing terminal 45 and printed on log sheet 46 in response to predetermined mnemonics. All bar mill order information and other signals relating to bar speed, size, grade, temperature and/or shape may be called from their respective sources through computer 15 and displayed on bar mill CRT terminal 47, also in response to predetermined mnemonics.

COMPUTER

Figure 12:
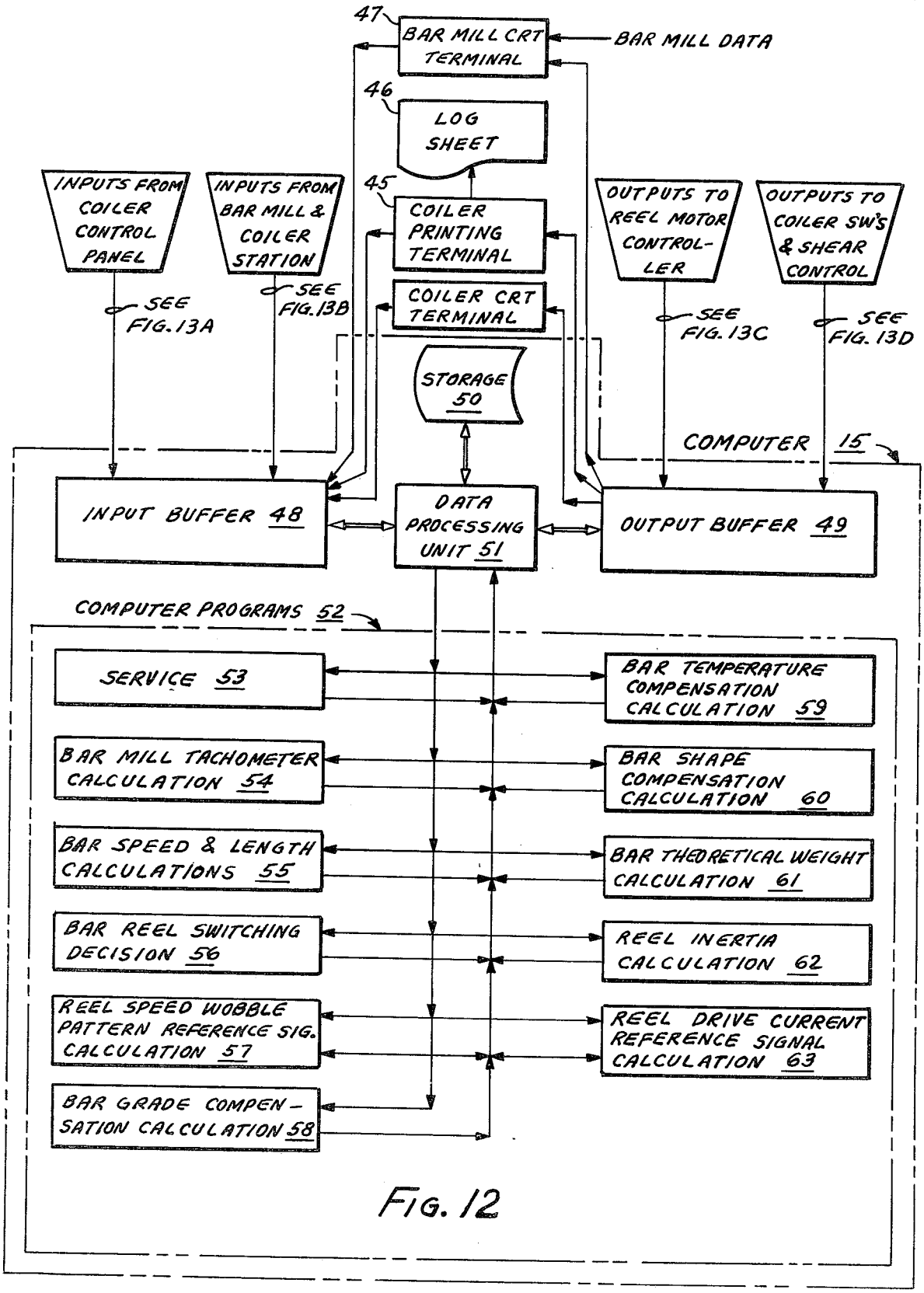
FIG. 12 is a block diagram of the digital computer shown in FIG. 1 and includes references to computer program flow charts shown in FIGS. 14 to 23.

Turning now to FIG. 12, a block diagram is shown of computer 15 used in the selectable coiling control system shown in FIG. 1. Computer 15 is a commercially available digital mini-computer programmed to perform the various functions described below. If desired, computer 15 may be shared with other functions in an overall rolling and coiling mill control computer installation.

Computer 15 is provided with conventional main components including input buffer 48, output buffer 49, storage 50, all communicating by various channels with data processing unit 51. Computer 15 operations are controlled sequentially according to computer programs 52 which comprise: service programs 53, bar mill tachometer calibration 54, bar speed and length calculations 55, bar reel switching decision 56, reel speed wobble pattern reference signal calculation 57, bar grade compensation calculation 58, bar temperature compensation calculation 59, bar shape compensation calculation 60, bar theoretical weight calculation 61, reel inertia calculation 62, and reel drive current reference signal calculation 63. Flow charts for each of these computer programs are shown in FIGS. 14 to 23 and described below.

Figure 13A:
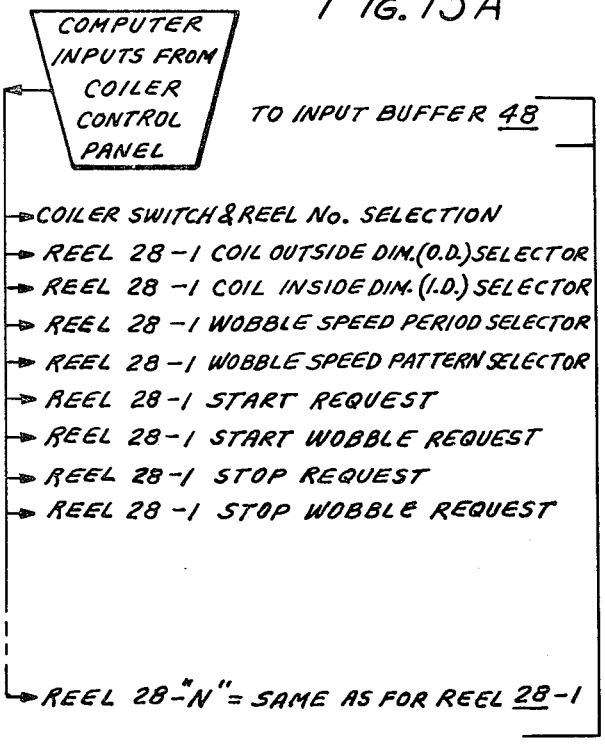
FIGS. 13A, 13B are listings of computer inputs from the coiler control panel, and from the bar mill and coiler station, respectively, as shown in FIG. 1.
Figure 13B:
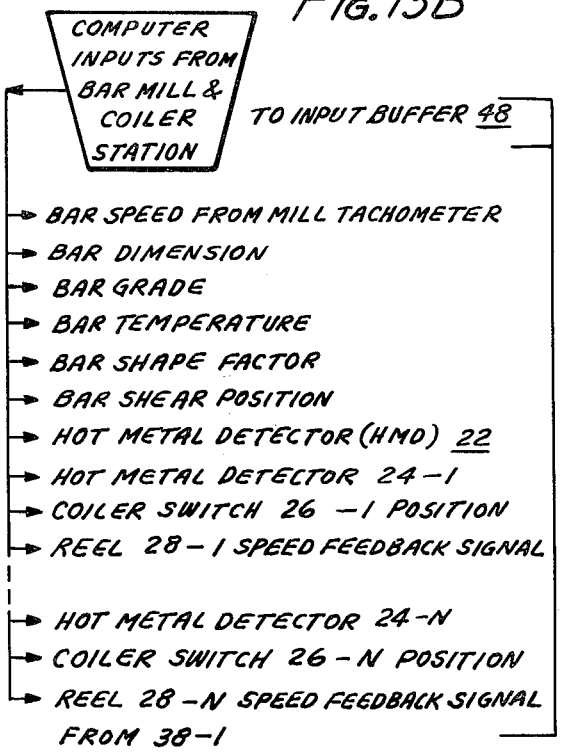

All cmmunications to computer 15 from external sources are by way of input buffer 48 which includes means for acquiring and converting analog and digital signals into computer digital form, and includes means for counting digital pulses. A list of signals fed to input buffer 48 from coiler control panel 32 is shown in FIG. 13A, and from the bar mill and coiling station 16 are shown in FIG. 13B. In addition, input buffer 48 is adapted to receive operator interaction command signals from coiler CRT terminal 44, coiler printing terminal 45 and bar mill CRT terminal 47.

Figure 13C:
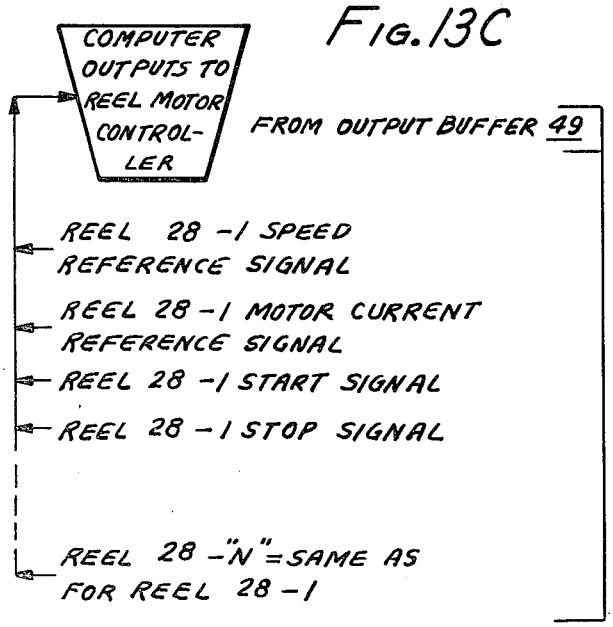
FIGS. 13C, 13D are listings of computer outputs to the reel motor controller, and coiler switches and shear controller, respectively, as shown in FIG. 1.
Figure 13D:
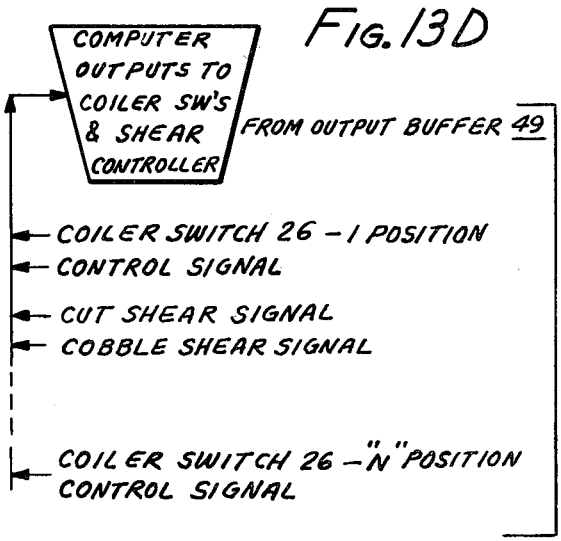

All communications from computer 15 to external sources are by way of output buffer 49 which includes means for converting and transmitting computer digital form signals into analog and other digital signals. A list of signals fed from output buffer 49 to reel speed controllers 33-1 to 33-N is shown in FIG. 13C, and to coiler switches 26-1 to 26-N and shear motor controller 39 is shown in FIG. 13D. In addition, output buffer 49 is adapted to transmit operator interactive display signals from coiler CRT terminal 44, coiler printing terminal 45 to produce log sheet 46, and bar mill CRT terminal 47.

COMPUTER PROGRAMS

SERVICE PROGRAM 53. This is a standard auxiliary subroutine appended before each of the other program routines and is discussed without benefit of a flow chart because of its commonality. This subroutine is used within input and output buffers 48, 49 and storage and data processing units 50, 51 for automatically directing the aquisition, conversion, manipulation, transmission and storage of data within computer 15.

Figure 14:
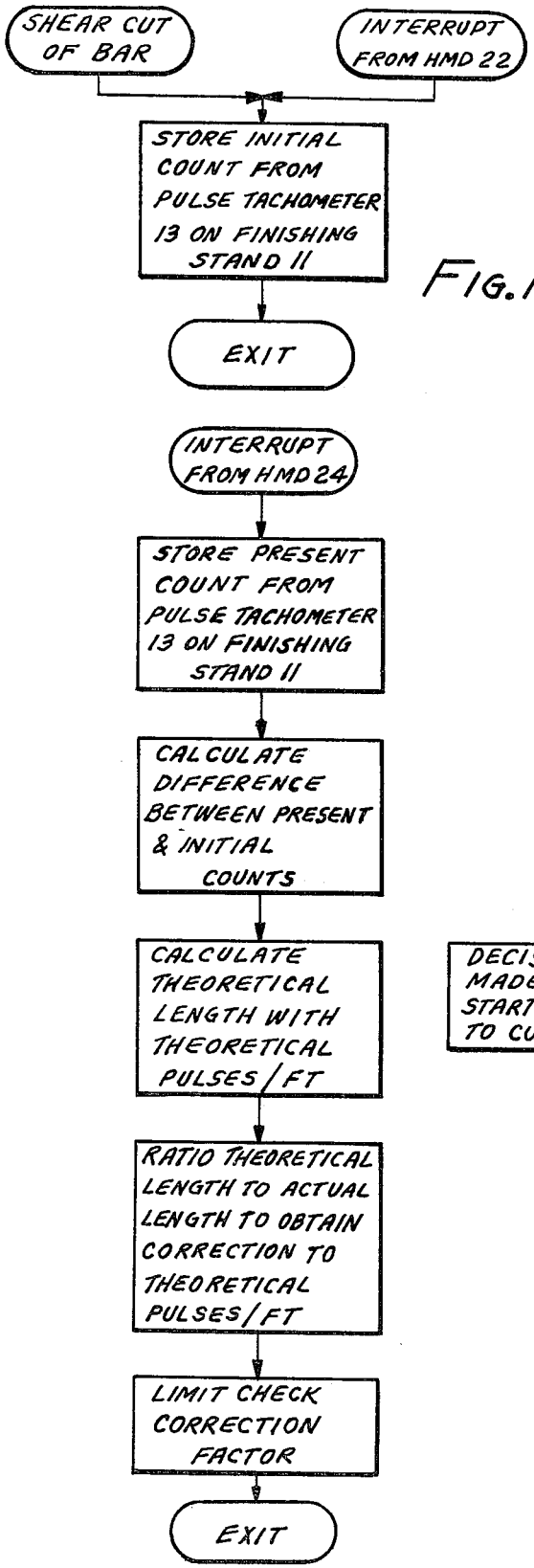
FIG. 14 is a computer program flow chart of the calibration of a finishing stand tachometer.

BAR MILL TACHOMETER CALCULATION 54, see FIG. 14 flow chart. This program is run as an initial part of bar 10 speed and length measurements and calculations performed by the selectable coiler control system shown in FIG. 1. Briefly, bar speed calibration is established, checked and corrected, if necessary, by measuring bar speed at mill speed tachometer 13, detecting the effect of changes in mill roll diameter relationship to bar speed pulses/min. and first correcting bar speed input signal at computer 15, then automatically correcting reel speed reference signal sent to controllers 33-1 to 33-N.

Bar speed measurements begin when bar 10 exits from mill finishing stand 11 and the front end of bar 10 is sensed by hot metal detector 22, or when a bar divide cut is completed. Computer 15 stores in a counter the initial reading of pulses from mill speed tachometer 13. When the front end of bar 10 is sensed by one of the selected hot metal detectors 24-1 to 24-N, computer 15 stores the present counter reading and takes the difference between the present and initial counts and stores this count difference.

Based on this count difference, computer 15 calculates what the theoretical length of bar 10 would be if a theoretical pulses-per-foot of bar 10 length were used, the latter factor being based on tachometer 13 pulse count in relation to finishing stand 11 roll circumference. Next, computer 15 calculates the ratio of theoretical length to the actual length selected from $L_1$ to $L_n$ to obtain a correction factor to the theoretical pulses-per-foot. Finally, computer 15 limit-checks the correction factor and produces a corrected bar speed signal.

An advantage in using this method of measuring bar speed is that in the event of a bad calibration of mill speed tachometer 13 occuring, or inaccurate effective roll diameter input, the theoretical pulse-per-foot may still be used by maintaining the correction factor at 1.0, or at the last good correction factor, until recalibration of tachometer 13 is made.

Figure 15:
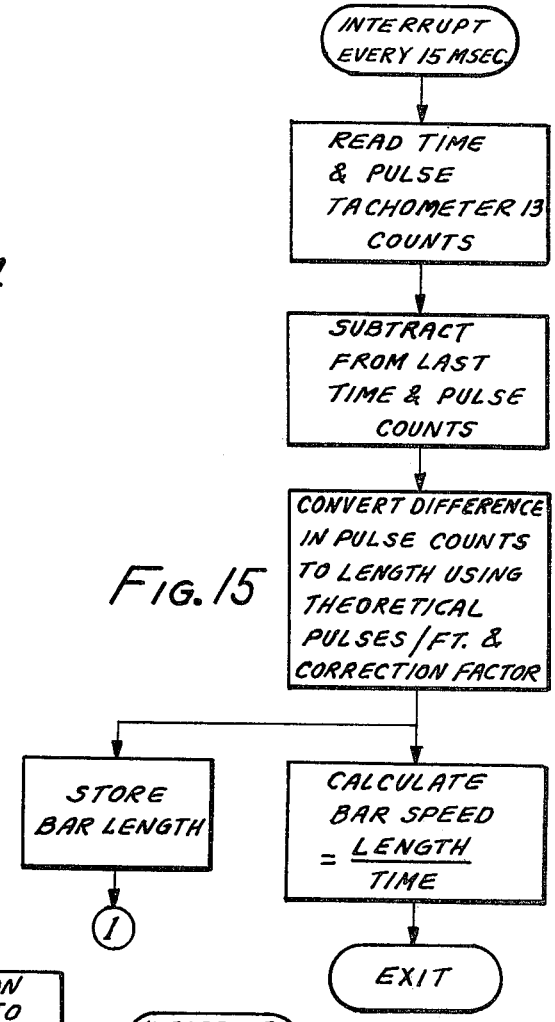
FIG. 15 is a computer program flow chart of bar speed and bar length calculations.

BAR SPEED AND LENGTH CALCULATION 55, see FIG. 15 flow chart and FIG. 1 block diagram. This program is run as a companion part of program 54 to calculate the speed and length of bar 10 instead of calibrating bar speed as in program 54. Computer 15 runs a bar speed and length calculation every 15 msec. First, it reads the count on a time counter and reads the count on the pulse counter driven by mill speed tachometer 13, then takes the difference from the last reading on both counters. The difference in pulses is converted to length of bar 10 using the theoretical pulse-per-foot and correction factor used in program 54. Bar length is stored for the duration of the program run and for use in calculating bar 10 speed by dividing bar length by time.

Figure 16:
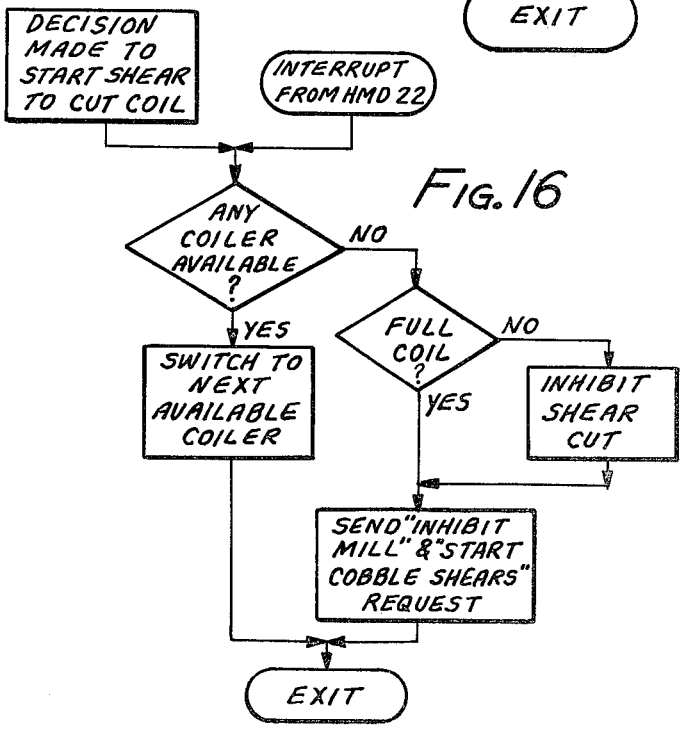
FIG. 16 is a computer program flow chart of a coiler reel switching decision.

BAR REEL SWITCHING DECISION 56, see FIG. 16 flow chart and FIG. 1 block diagram. This program is started when bar 10 exits from bar mill finishing stand 11 and the front end of bar 10 is sensed by hot metal detector 22, or when a decision is made to start shear 41 to divide cut bar 10 but before the cut is actually initiated. Computer 15 then checks the availability of one of the pouring reels 28-1 to 28-N by sensing their respective ready-to-receive signals. It selects the next available pouring reel for coiling that is at base speed. At the same time computer 15 selects one or more of coiler switches 26-1 to 26-N to direct bar 10 movement into the selected pouring reel.

During roation of the selected pouring reel 28-1 to 28-N, computer 15 queries the predetermined coiling level, inhibits a divide shear cut signal until the reel is at the predetermined coiling level, then either causes shear 41 to cut bar 10 or permits the coiler operator to do so manually only if an operable pouring reel is available.

If none of the pouring reels 28-1 to 28-N are ready or available to receive moving bar 10, computer 15 sends a "start cobble shear" signal to shear motor controller 39, or to an equivalent, and causes bar 10 to be cut up to prevent a cobble. At the same time, computer 15 sends an "inhibit mill" signal to the bar rolling mill to prevent entry of another billet into the bar mill.

REEL SPEED WOBBLE REFERENCE SIGNAL CALCULATION 57. See FIGS. 17A, 17B flow charts, FIG. 1 block diagrams, FIGS. 5 to 8 speed reference graphs, and FIGS. 2, 3, 4 plan-view coiling diagrams. This program is run to generate each of the entire reel speed reference signals shown in FIGS. 5, 7, 8, and fed the preselected one of these to the selected reel speed controller 33-1 to 33-N for the purpose of starting, stopping, and controlling the speed wobble patterns of the selected pouring reel 28-1 to 28-N. Flow charts 17A, 17B cover only the program for the three different four-segment roll speed wobble patterns shown in FIG. 6, but not the entire speed reference signal waveform shown in either FIG. 5, 7 or 8. Generating the remaining portion, that is, the reel speed start, stop and idle sections, is believed obvious to one having ordinary skill in the art.

Figure 2:
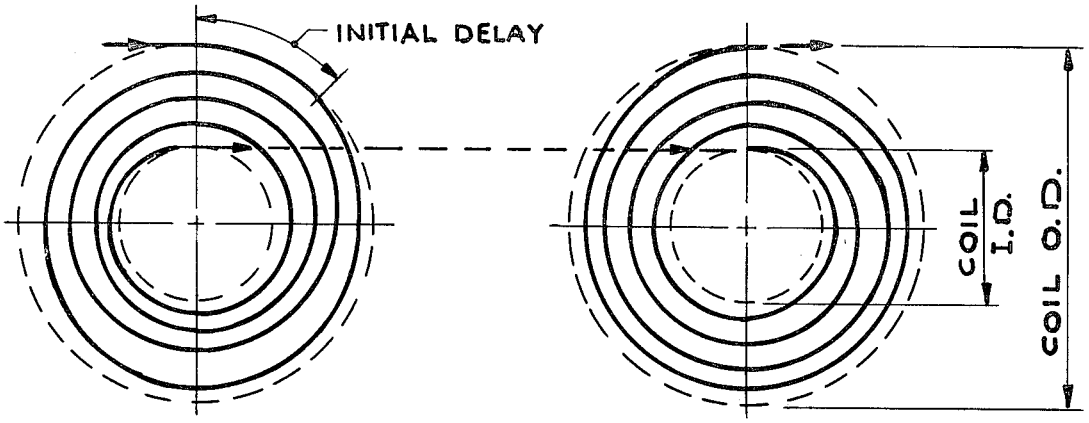
FIGS. 2, 3 and 4 are plan-view coiling diagrams representing the coiled product distribution in the reel resulting from using four-segment Archimedes spiral, spiral with dwell, and triangular waveforms, respectively, in generating the various reel speed reference signals used herein.
Figure 3:
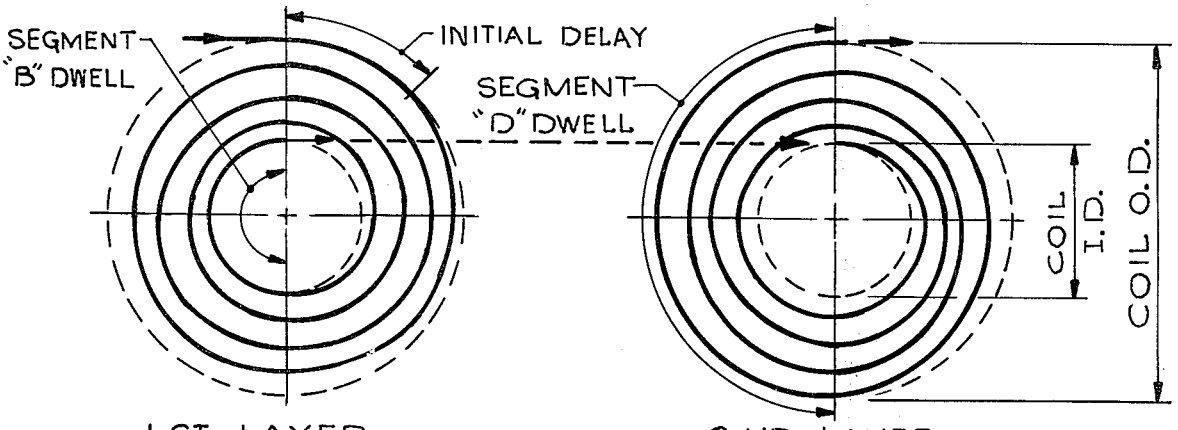
Figure 4:
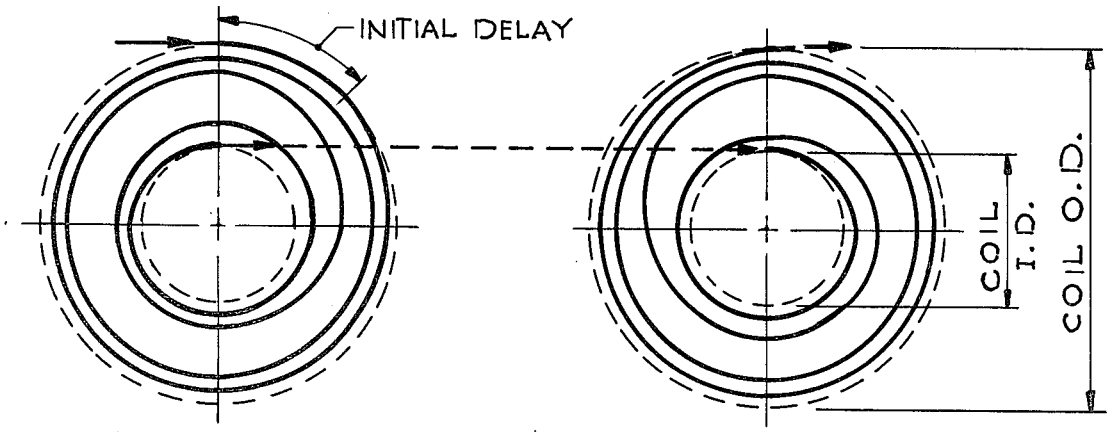

In order to achieve maximum theoretical coil density, reel speed at the point of contact with bar 10 must always be equal to bar speed regardless of where bar 10 is located laterally between pouring reel O.D. and I.D. This means that pouring reel speed must vary cyclically and that reels 28-1 to 28-N must make fewer r.p.m. when bar 10 is at pouring reel O.D. 36 than at I.D. 37. Heretofore, this cyclic reel speed variation, or reel speed wobble, has been referred to as an Archimedes spiral pattern to explain the behaviour of bar 10 during coiling between pouring reel O.D. and I.D. limits as shown in FIGS. 2, 3, 4. Three four-segment reel speed wobble patterns programmed herein for computer 15 solution are shown in FIG. 6.

The present computerized coiling control system is programmed to solve reel speed wobble pattern equations stated below in general form for each of the four segments A, B, C, D shown in FIG. 6. Numerical values for precalculated portions of these equations pertaining to characteristics of waveform and other parameters programmed herein is tabularized in appended TABLE 1, Parts 1, 2, 3. Each of these Parts corresponds to the three different wobble patterns shown in FIG. 6.

Changes to the basic reel speed wobble pattern to compensate for variations in bar 10 outside dimension (O.D.) say from 0.500 to 2.000 inches (1.27 to 5.08 cm.) O.D., occurs automatically by computer 15 searching TABLE 1 for the bar O.D. range closest to the bar dimension signal fed to computer 15 from device 15 in FIG. 1. Changes to the basic reel speed wobble patterns to further compensate for bar grade, bar temperature, and bar shape are discussed below under programs for calculations 58, 59, 60, respectively.

Figure 6:
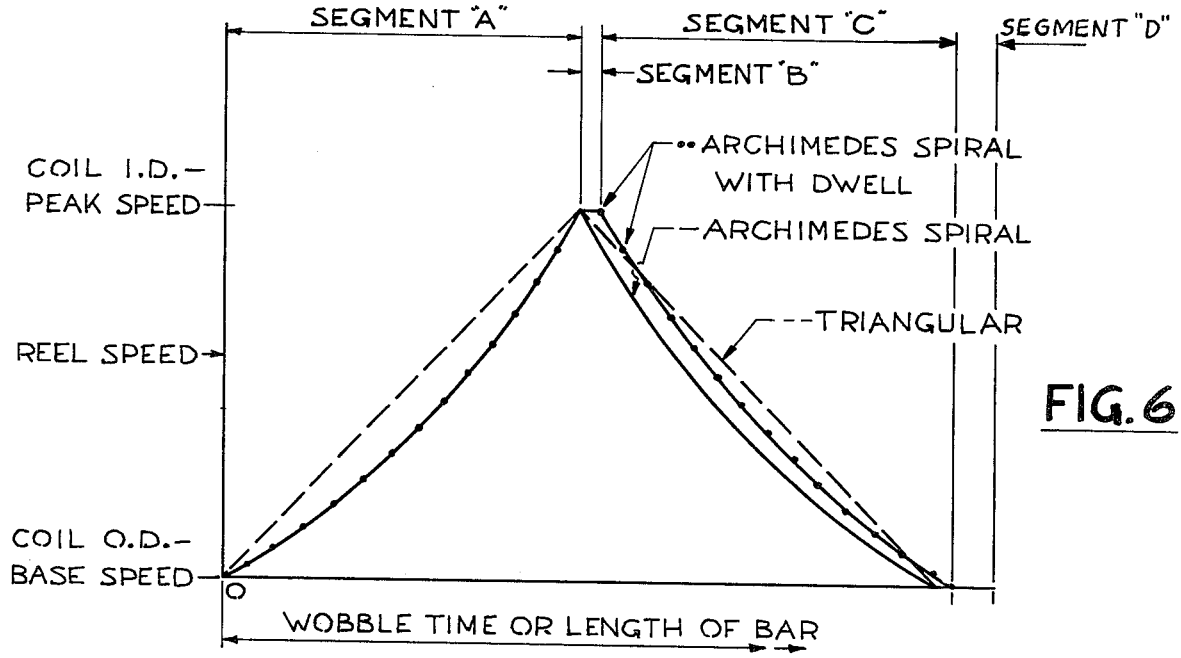
FIG. 6 is an enlarged graph showing four-segment reel speed wobble patterns associated with Archimedes spiral, spiral with dwell and triangular waveforms. All wobble patterns may be assumed to have varying dwell times.

Further, computer 15 may be programmed to choose between different sets of tables for the purpose of generating completely different reel speed wobble patterns to fit a variety of coiling situations other than those covered by FIG. 6. In addition, each segment A, B, C or D in any of the reel speed wobble patterns may be changed independently of the others by way of instructions from coiler CRT terminal 44 for changing appropriate values in TABLE 1, Parts 1, 2, 3 or other additional Parts. This affords greater operator flexibility in attempting to produce denser coils under less than ideal operating conditions.

As mentioned above, coiler control panel 32 is provided to minimize coiler operator setups for the variety of coiling situations encountered in practice. One operator control on this panel is the reel speed wobble pattern switch for selecting one of the three or more four-segment reel speed wobble patterns that are shown in FIG. 6. The first of these patterns is identified as the Archimedes spiral, the second a spiral with dwell, and the third a triangular waveform. Each of these wobble patterns, together with TABLE 1, Parts 1, 2, 3, cause computer 15 to generate a reel speed reference signal which varies in accordance with FIGS. 5, 7, 8.

Under ideal coiling conditions the three reel speed wobble patterns will produce spiral layer coils corresponding to the plan-view diagrams shown in FIGS. 2, 3, 4. When less than ideal operating conditions are encountered, the reel speed wobble pattern selector may have another advantage to the coiler operator to get rid of bar hang-ups in the pouring reels by switching from one reel speed wobble pattern to another, thereby improving coil density.

Coiler control panel 32 is also provided with three additional operator controls which permit the coiler operator to preselect coil O.D. size, coil I.D. size, and reel speed wobble time, or rate, independently of each other as well as independently, of bar speed. All of these adjustments provide for improved coil density.

Figure 5:
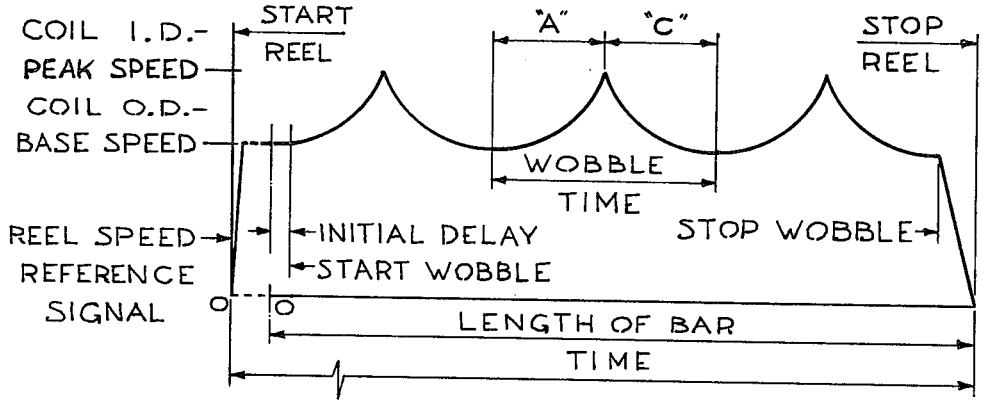
FIG. 5 is a graph showing reel speed reference signal vs. either bar length or time when using the Archimedes spiral waveform as required to form the FIG. 2 coil.
Figure 7:
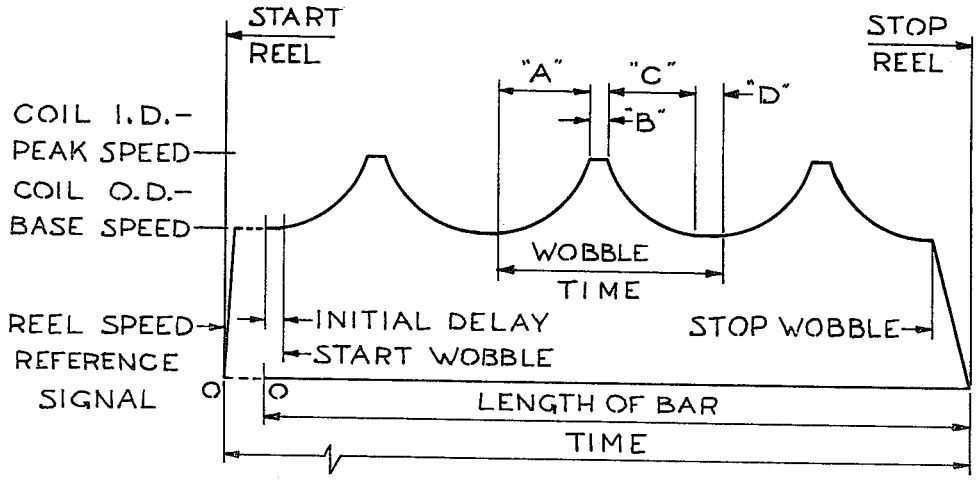
FIGS. 7 and 8 are graphs showing reel speed reference signal vs. either bar speed or length when using the respective spiral with dwell and triangular waveforms as required to form the FIGS. 3 and 4 coils.
Figure 8:
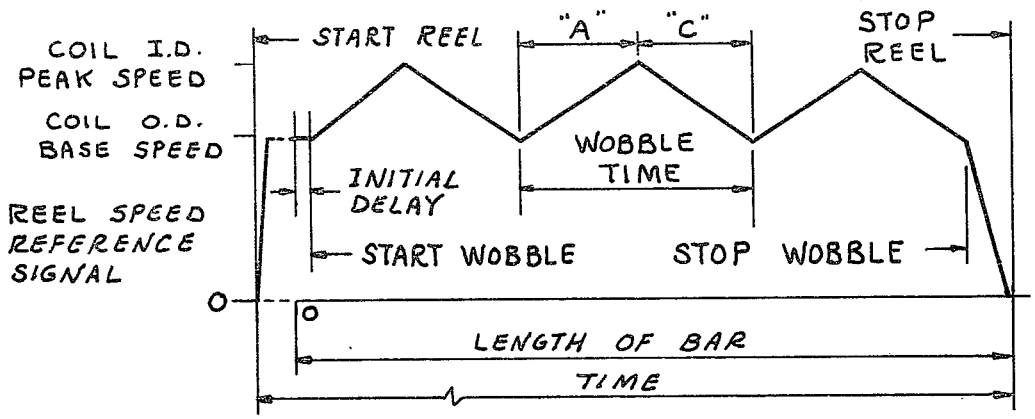

The coil O.D. size control establishes a value for the O.D. variable in the equations stated below, as well as establishing the pouring reel base speed in FIGS. 5, 7, 8. Increasing coil O.D. size control reduces reel base speed and moves bar 10 closer to reel O.D. but, of course, cannot exceed this value. Reducing coil O.D. size control increases reel base speed and moves bar 10 away from reel O.D. but cannot equal coil I.D. size.

The coil I.D. size control establishes a value for the I.D. variable in the equations below, as well as establishing the pouring reel peak speed in FIGS. 5, 7, 8. Increasing coil I.D. size control increases reel peak speed and moves bar 10 closer to the reel I.D. but, of course, cannot be smaller than this value. Reducing coil I.D. size control reduces reel peak speed and moves bar 10 toward reel O.D. but cannot equal coil O.D. size.

When the coiler operator preselects the wobble time control, a value is established for the LF length factor in the equations below, as well as a value being established for the wobble time interval between valleys in the waveforms shown in FIGS. 5, 7, 8. Increasing the wobble time increases the length of bar that lies between the coil O.D. and I.D., and vise versa.

Thus, it will be appreciated that the controls on panel 32, which are preselected by the coiler operator, affect the reel base speed, reel peak speed and the time of the reel speed wobble pattern cycle. In practice, these controls are independent of reel speed and are related to the physical parameters identified as coil O.D. and I.D. and the wobble time ratioed to a theoretical wobble time. Hence, when setting up the coiler, the coiler operator need only remember the control settings, not the actual base and peak speeds and wobble time period in relation to bar speed.

A major portion of the reel speed reference signal is generated by computer 15 calculating the three four-segment reel speed wobble patterns shown in FIG. 6 and based on the following equations:

Equation For Segment A (Eq. 1)

$$S_R = S_B \times \frac{ROD}{OD - D_E}\,[1.0 + RMF[A_1(L \times LF) + A_2(L \times LF)^2 + A_3(L \times LF)^3]]$$

For $\leqq L \times LF \leqq SL_A$

Equation For Segment B (Eq. 2)

-continued $$S_R = S_B \times \frac{ROD}{ID + D_E}$$

For $O \leqq L \times LF \leqq SL_B$

Equation For Segment C (Eq. 3)

$$S_R = S_B \times \frac{ROD}{OD - D_E} [1 + RMF[C_1(SL_C - L \times LF) + C_2(SL_C - L \times LF)^2 + C_3(SL_C - L \times LF)^3]]$$

For $O \leqq L \times LF \leqq SL_C$

Equation For Segment D (Eq. 4)

$$S_R = S_B \times \frac{ROD}{OD - D_E}$$

For $O \leqq L \times LF \leqq SL_D$

Where:

$S_R$ = Linear reel speed based on reel O.D. and R.P.M.

$S_B$ = Measured (and corrected) bar speed.

ROD = Reel outside dimension (OD).

RID = Reel inside dimension (ID).

OD = Coil outside dimension (OD), sets OD Base speed.

ID = Coil inside dimension (ID), sets ID Peak speed.

$D_E$ = The effective bar dimension used for calculating incremental increase in the reel speed above base speed vs. length of bar product in reel since start of wobble. This parameter is the hot bar dimension of the largest bar in the range of cold bar dimension that will fit N rings in one layer. N varies from 4 to 15 for a reel I.D. of 38.5" and O.D. of 54.5".

RMF = Ratio multiply factor.

$$= \frac{\frac{OD - D_E}{ID + D_E} - 1}{TMR} \quad \text{(Eq. 5)}$$

TMR = Theoretical maximum ratio.

$$= \frac{ROD - D_E}{RID + D_E} - 1 \quad \text{(Eq. 6)}$$

L = Length of bar from start of segment, length counter is set to zero for each segment.

LF = Length factor, preset by coiler operator with wobble time control.

$A_1$ = Coefficient 1st order Equation A $A_2$ = Coefficient 2nd order Equaltion A $A_3$ = Coefficient 3rd order Equation A $C_1$ = Coefficient 1st order Equation C $C_2$ = Coefficient 2nd order Equation C $C_3$ = Coefficient 3rd order Equation C $SL_A$ = Sumlength A $SL_B$ = Sumlength B $SL_C$ = Sumlength C $SL_D$ = Sumlength D $$OD \text{ Base Speed} = \frac{ROD}{OD - D_E} \times S_B \quad \text{(Eq. 7)}$$

$$ID \text{ Peak Speed} = \frac{ROD}{ID + D_E} \times S_B \quad \text{(Eq. 8)}$$

Thus, the coiler operator can change the OD and ID speeds simply by changing the coil OD and coil ID control settings on panel 32. It should be noted that the coil OD and coil ID controls do not interact with each other when making a change in either the base reel speed or peak reel speed.

It should be further noted that changes in the wobble time control on panel 32 changes the time it takes for the pouring reel 28-1 to 28-N to go from OD Base Speed to ID Peak Speed. The wobble time control changes the LF (length factor) which changes the length of bar product that goes into one spiral layer in the reel. The LF range is determined by this calculation 57 and will be easily changed.

Figure 17A:
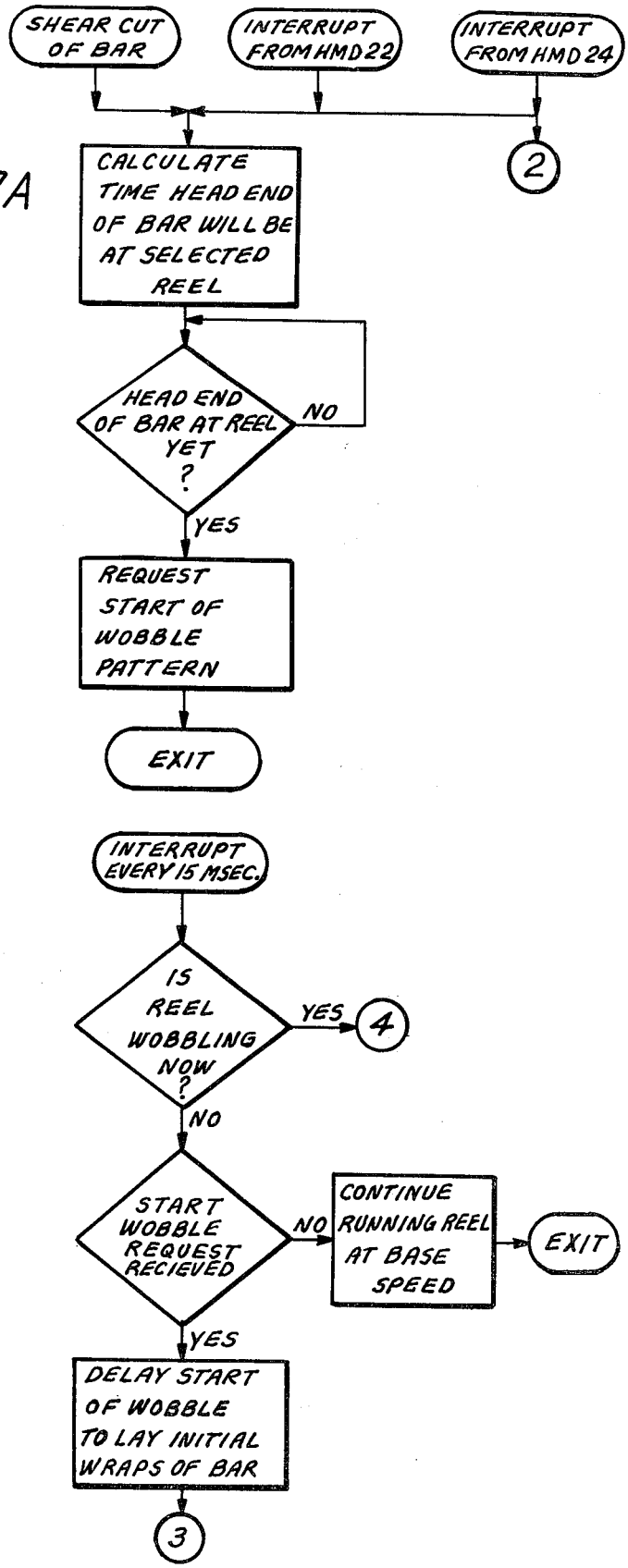
FIGS. 17A, 17B are computer program flow charts of reel speed wobble pattern generation.
Figure 17B:
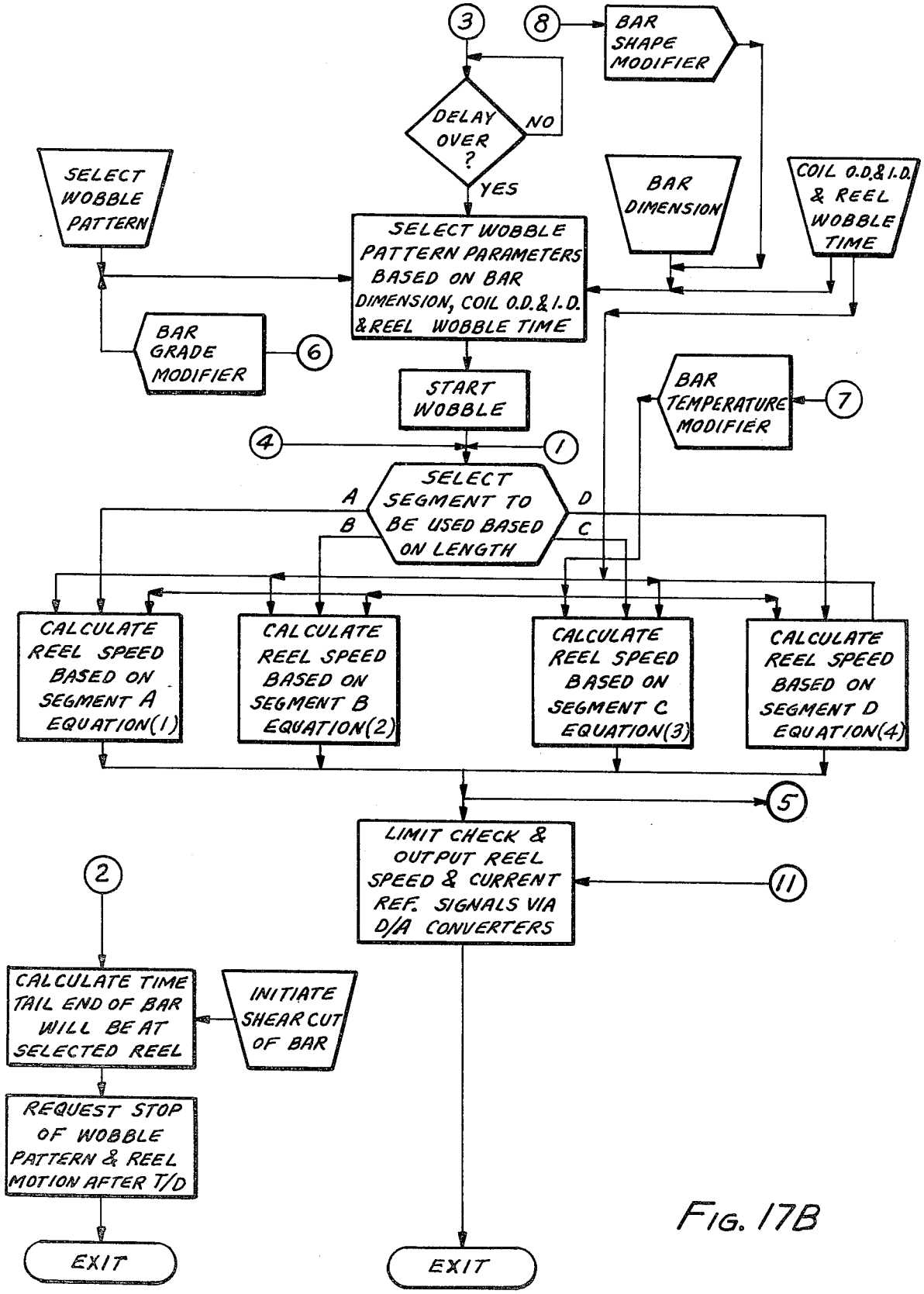

The reel speed pattern reference signal calculation program 57, FIGS. 17A, 17B flow charts, is started when bar 10 exits from finishing stand 11 and the front end reaches hot metal detector 22, or receives a divide cut from shear 41, or the front end of bar 10 reaches the selected hot metal detector 24-1 to 24-N. A calculation is made of the time the head end of bar 10 will reach the selected pouring reel 24-1 to 24-N based on known length $L_1$ to $L_n$ and the bar speed. When this time has elapsed, a start wobble request is initiated and computer 15 will start calculation of the reel speed wobble pattern equations and call tabular data from TABLE 1, Part 1, 2 or 3 corresponding to the selected wobble pattern.

The reel speed wobble pattern reference signal calculation 57 is run every 15 msec. It starts the selected pouring reel 28-1 to 28-N and builds reel speed up to base speed, wobbles the selected pouring reel speed between base speed and peak speed, and when all of the bar 10 is in the pouring reel, reduces reel speed to zero. One of FIGS. 5, 7, 8 illustrate the reel speed reference signal generated, and one of FIGS. 2, 3, 4 show a plan-view diagram of the coil of bar 10 in the selected pouring reel 28-1 to 28-N.

When the start wobble request is received, the start of the reel speed wobble is delayed for a fixed length of bar 10 in the first layer of coil. FIGS. 2, 3, 4 show this initial delay length to be the same length in each coiling pattern. However, in practice the initial delay length may be a different value for each pattern, or may be a full turn or more. In any event, the purpose of the initial delay length is to insure that the first portion of the bar coil lays on the outside diameter of the pouring reel.

After the initial delay is over, computer 15 selects the parameters for calculating the reel speed wobble pattern reference signals. These parameters include: bar dimension, such as diameter of round bar; coil O.D., coil I.D. and wobble time; and reel speed wobble pattern preselected by the coiler operator according to a number. When the reel speed wobble pattern is selected, computer 15 accesses the wobble pattern number and calls the stored data from TABLE 1, Part 1, 2, or 3, depending on which wobble pattern was selected. Thus, with this method it is possible to have different wobble patterns stored for all pouring reels, if desired.

Next, computer 15 calls for a bar speed signal from connection 1 in FIG. 15, and calls for a confirmation that the pouring reel is running from connection 4, FIG. 17A. Then, computer 15 selects a segment A, B, C or D of the wobble pattern to be used in calculations and selects a predetermined length of bar 10 for that segment. Thereafter, the computer calculates the reel speed reference signal according to the Segment A equation (Eq. 1) and outputs the reel speed signal on connection 5, FIG. 17B for use in calculating the reel motor current reference signal described below. Both the reel speed reference signal and the reel motor current reference signal are limit-checked in computer 15 and then fed to the selected reel speed controller 33-1 to 33-N for controlling the speed of the selected pouring reel 28-1 to 28-N.

On the next 15 msec. interrupt, computer 15 again calculates the reel speed reference signal according to Segment A equation. This calculation is repeated again on each successive interrupt until the bar length counter for that Segment exceeds the $SL_A$ (Sumlength A) value in TABLE 1, Part 1, 2 or 3.

After $SL_A$ is exceeded, computer 15 chooses the Segment B equation (Eq. 2) and rezeroes the bar length counter. Segment B is used in calculating the reel speed wobble pattern reference signal in the same manner as Segment A until $SL_B$ (Sumlength B) is exceeded in TABLE 1, Part 1, 2 or 3, and the bar length counter is rezeroed. This same procedure is used sequentially in selecting and calculating Segments C and D equations (Eq. 3 and 4) until their respective $SL_C$ and $SL_D$ (Sumlength C and Sumlength D) are exceeded in TABLE 1, Part 1, 2 or 3. Thereafter, Segment A equation is again selected and the entire procedure repeated to generate a continuous reel speed wobble pattern reference signal.

This program is concluded when the tail end of bar 10 generates an interrupt signal at hot metal detector 24, or an initiation of a shear cut of bar 10 is made at shear 41. A calculation is then made of the time the tail end of bar 10 will be at the selected pouring reel 281 to 28-N. After this time has elapsed, a stop wobble is initiated, then after a time delay a stop reel motion request is sent to reel speed controller 33-1 to 33-N.

Figure 21:
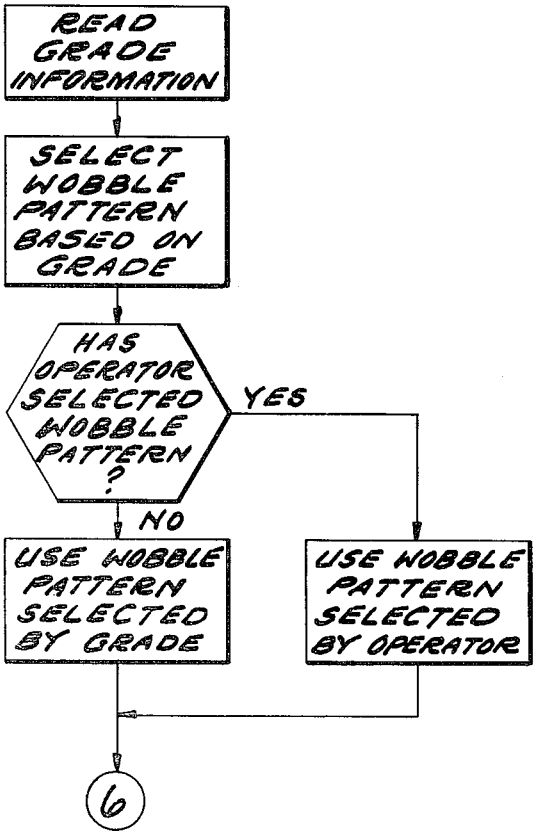
FIGS. 21, 22, 23 are computer program flow charts of respective product grade, temperature and shape compensation of the reel speed reference signal.

BAR GRADE COMPENSATION 58, see FIG. 21 and FIG. 17B flow charts. If bar grade or material compensation of the reel speed wobble pattern reference signal is desired, this program 58 may also run at 15 msec. intervals the same as those for calculating segment equations A, B, C, D in program 57.

This program is started when bar grade information is fed into computer 15 and a selection is made of the reel speed wobble pattern. Instead of calling data from storage based on only bar dimension range, TABLE 1 is extended to include tabular data based on both a range of bar dimensions and a range of bar grades. If the coiler operator has already selected a reel speed wobble pattern without the benefit of grade compensation, use the preselected wobble pattern. Otherwise, computer 15 will use the reel speed wobble pattern modified by grade information as the selected wobble pattern. This modification occurs through connection 6 on FIGS. 21 and 17B flow charts and runs for the same duration as program 57.

Figure 22:
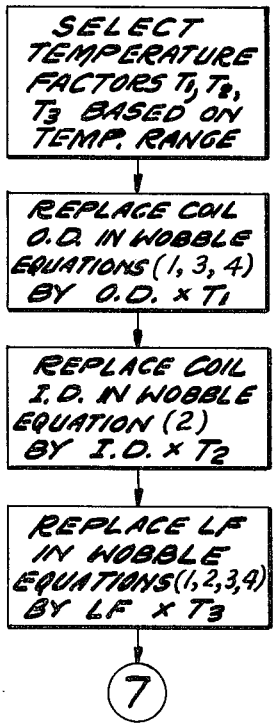

BAR TEMPERATURE COMPENSATION CALCULATION 59, see FIGS. 22 and 17B flow charts. If bar temperature compensation of the reel speed wobble pattern reference signal is desired, this program 59 is also run at 15 msec. intervals the same as those for calculating equations A, B, C, D in program 57.

This program is started by selecting and storing temperature factors $T_1$, $T_2$, $T_3$ based on range of temperature of hot bar 10 and then storing these factors. Next, replace the preselected term "Coil OD" in reel speed wobble pattern segment equations 1, 3 and 4 with a modified term "Coil OD $\times$ $T_1$." Next, replace the preselected term "Coil ID" in reel speed wobble pattern segment equation 2 with a modified term "Coil ID $\times$ $T_2$." Thereafter, replace the preselected term "LF" (length factor) everywhere in reel speed wobble pattern segment equations 1, 2, 3 and 4 with a modified term LF $\times$ $T_3$. This modification occurs through connection 7 on FIGS. 22 and 17B flow charts and also runs for the same duration as program 57.

Figure 23:
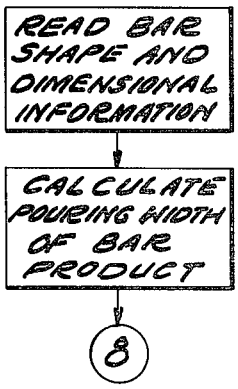

BAR SHAPE COMPENSATION CALCULATION 60, see FIGS. 23 and 17B flow charts. If bar shape compensation of the reel speed wobble pattern reference signal is desired, this program 60 may also run at 15 msec. intervals the same as those for calculating segment equations A, B, C and D in program 57.

This program is started by reading the shape and dimension information fed to computer 15 from gage 17 or other sources. Next, calculate the pouring width of bar 10 or other product being coiled in pouring reel 28-1 to 28-N and use this parameter in place of "bar dimension" in TABLE 1, all Parts. The pouring width is the lateral dimension of bar 10 as it lays adjacent one another in flat spiral turns in the selected pouring. When bar 10 is round or square, round being exemplified by stored data in TABLE 1, Parts 1, 2, 3, etc., then the pouring width is bar diameter for rounds or width for squares. When bar 10 is a flat and poured standing on edge, the pouring width is the flat thickness. Conversely, when a flat is poured flat instead of on edge, then the pouring width is the flat width. When bar 10 has a hexagonal, oval, or other cross-sectional shape with one lateral dimension larger than another lateral dimension, the pouring width is the lateral dimension across adjacent surfaces in the flat spiral.

When the pouring width has been determined, the resulting dimension is used to modify the bar dimension value in determining bar dimension range in TABLE 1, Part 1, 2, 3, etc. This modification occurs through connection 8 on FIGS. 23 and 17B flow charts and also runs for the duration of program 57.

Figure 18:
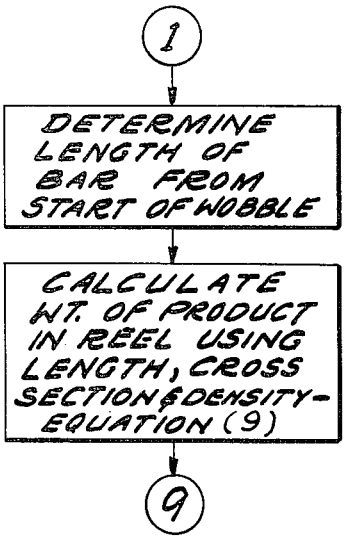
FIGS. 18, 19 are computer program flow charts of respective bar theoretical weight and pouring reel inertia calculations used in the calculation of the reel motor current reference signal.
Figure 19:
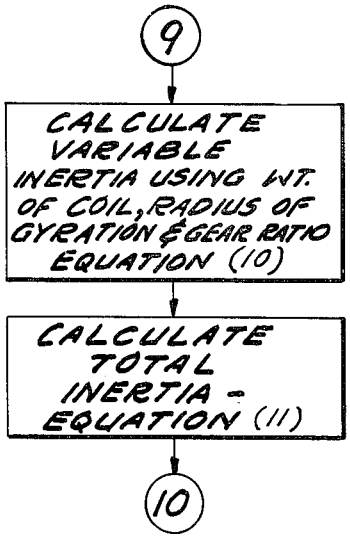

BAR THEORETICAL WEIGHT CALCULATION 61, see FIGS. 18, 15 and 19 flow charts. Program 61 shown in FIG. 18 flow chart is run with programs 62 and 63 at 15 msec. intervals the same as those for calculating segment equations A, B, C and D in program 57.

This program is started by determining bar length from start of reel speed wobble by calling the stored bar length value through connection 1 in FIG. 15 flow chart. Next, computer 15 calculates the weight W of bar 10 or other product in the selected pouring reel 28-1 to 28-N by the following equation:

$$W = L \times A \times D \qquad \text{(Eq. 9)}$$

where:

L = stored bar length

A = crossectional area of bar based on bar dimension and shape information

D = density of bar material

Figure 10:
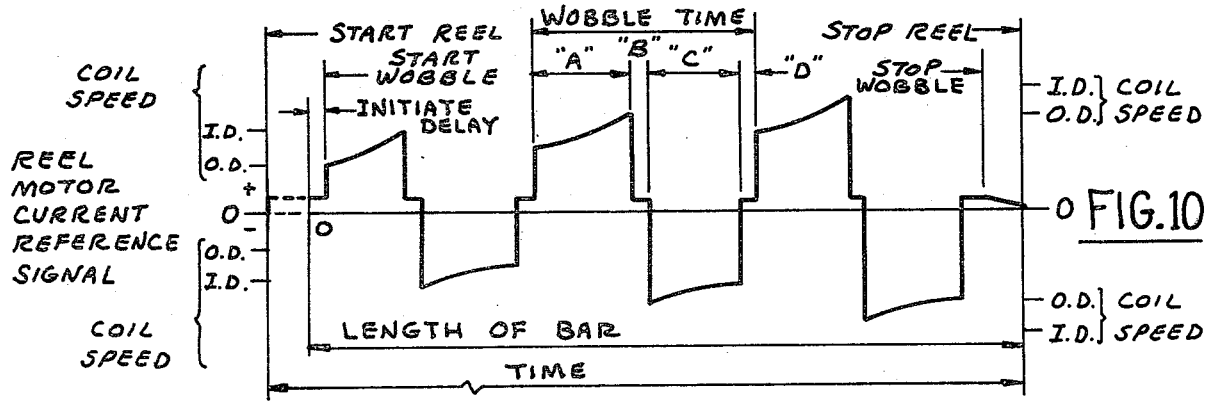

The theoretical weight calculated data is fed through connection 9 to FIG. 10 flow chart in reel inertia calculations. This program concludes when program 57 is concluded.

REEL INERTIA CALCULATION 62, see FIGS. 19, 18 and 17B flow charts. Program 62 shown in FIG. 19 flow chart is run to determine total inertia of the pouring reel and coil during coiling operations. This program is run at the same 15 msec. intervals as those for calculating segment equations A, B, C and D in program 57.

Program 62 is started by computer 15 calculating:

$$\text{Variable Inertia} = \frac{W_1 \times R_1^2}{GR_1^2} \qquad \text{(Eq. 10)}$$

where:

$W_1$ = Weight of bar coil as it builds up, value determined by program 61 and obtained through connection 9 in FIG. 18.

$R_1$ = Radius of gyration of bar coil, a standard calculation using coil dimensions.

$GR_1$ = Gear ratio of pouring reel drive.

Next, computer 15 calculates:

$$\text{Total Inertia} = \text{Variable Inertia} + \text{Pouring Reel} + \text{Motor Inertia} \quad \text{(Eq. 11)}$$

where:

$$\text{Pouring Reel} + \text{Motor Inertia} = \frac{W_2 \times R_2^2}{GR_1^2} + \text{Motor Inertia} \quad \text{(Eq. 12)}$$

where:

$W_2$ = Weight of empty pouring reel.

$R_2$ = Radius of gyration of pouring reel, a standard calculation using reel dimensions.

$GR_1$ = Gear ratio of pouring reel drive.

Figure 20:
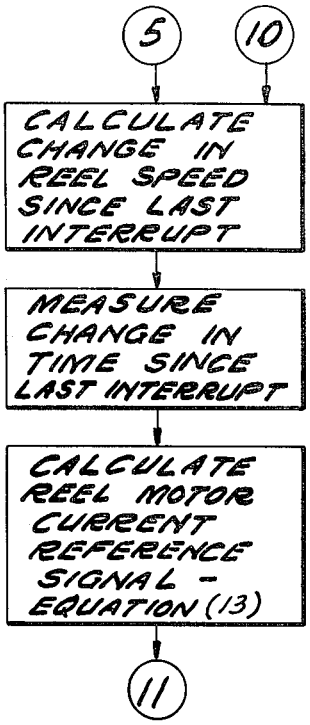
FIG. 20 is a computer program flow chart of the reel motor current reference signal calculation.

The total inertia calculation data is fed through connection 10 to FIG. 20 flow chart in reel drive current reference signal calculations. This program concludes when program 57 is concluded.

Figure 9:
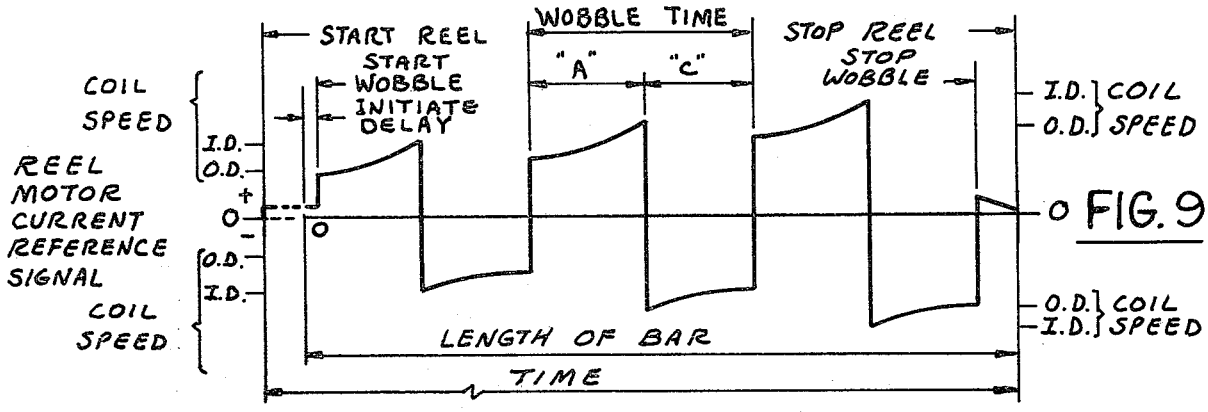
FIGS. 9, 10, 11 are graphs showing reel motor current reference signal vs. bar length or time when using the four-segment Archimedes spiral, spiral with dwell, and triangular reel speed reference signal waveforms shown in FIGS. 5, 7 and 8.
Figure 11:
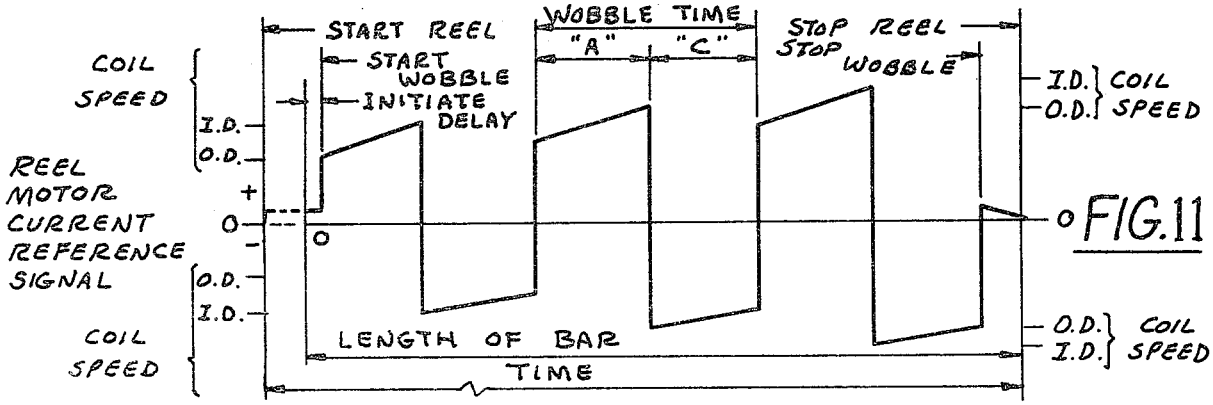

REEL DRIVE CURRENT REFERENCE SIGNAL CALCULATION 63, see FIGS. 20, 19 and 17B flow charts; and FIGS. 9, 10 and 11 graphs. Program 53 is shown in FIG. 20 flow chart is run to generate reel drive current reference signals FIGS. 9, 10, 11 graphs which is combined with the reel speed reference signal through connection 11 on FIG. 17B flow chart. This program is also run at the same 15 msec. intervals as those for calculating segment equations A, B, C and D in program 57.

Program 63 is started by computer 15 calculating the change in reel speed reference signal since last interrupt using the reel speed reference signal data received over connection 5 from FIG. 17B flow chart. Next, measure the change in time since last interput when reel speed reference signal was calculated. Thereafter, calculate the reel drive currect reference signal according to:

$$\text{Current} = \frac{(S_{R1} - S_{R2}) \times \text{Total Inertia} \times C_1}{\Delta\ \text{Time}} \quad \text{(Eq. 13)}$$

where:

$S_{R1}$ = Present reel speed reference signal.

$S_{R2}$ = Last reel speed reference signal.

Total Inertia = Equation 11.

$C_1$ = Output current scaling factor.

$\Delta$Time = change in time since last reel speed reference signal calculation.

The reel drive current reference signal, shown in either FIGS. 9, 10 or 11 graph, is fed through connection 11 to FIG. 17B flow chart where it is limit-checked along with the reel speed reference signal. Both of these reference signals are converted in a D/A converter in order that separate analog speed and current reference signals may be fed to reel speed controller 33-1 to 33-N where they are combined to control the speed and torque of pouring reels 28-1 to 28-n. Program 63 concludes when program 57 is concluded.

I claim:

1. In a coiling control system where a moving product is poured into a variable speed pouring reel to form layered coils therein, and where a product speed signal is generated, the improvement comprising:

a. means for calculating a selectable reel speed reference signal as a function of at least one parameter signal and at least one selection signal, the parameter signal including the product speed signal and the selection signal including a reel speed wobble pattern selection signal, b. means for producing at least one selection signal including the reel speed wobble pattern selection signal, and c. means for controlling the pouring reel speed in response to the selectable reel speed reference signal, thereby maximizing pouring reel coil density under a variety of coiling situations.

2. The control system of claim 1 wherein the calculating means is a programmed digital computer.

3. The control system of claim 1 wherein the calculating means produces the reel speed reference signal having a segmented wobble pattern occurring in a selected wobble time period.

4. The control system of claim 1 wherein the calculating means produces the reel speed reference signal having plural segments occurring in a selected wobble time period, whereby at least part of the calculation performed by said means is done with stored wobble pattern data.

5. The control system of claim 1 wherein the calculating means calculations further includes a variable reel speed wobble time period parameter determined by a wobble time selector signal produced in means b.

6. The control system of claim 1 wherein the calculating means calculations further includes an independently variable coil outside dimension parameter determined by a coil outside dimension selection signal produced by means b.

7. The control system of claim 1 wherein the calculating means calculations further includes an independently variable coil inside dimension parameter determined by a coil inside dimension selection signal produced by means b.

8. The control system of claim 1 wherein the calculating means calculations further includes a product speed signal correction parameter based on external signal sources detecting the head end of the moving product traversing a known distance in a known time period.

9. The control system of claim 1 wherein the calculating means further calculates moving product length as a function of the product speed signal and time.

10. The control system of claim 1 wherein the calculating means further calculates moving product length in a coil layer as a function of the product speed signal and time, and a reel speed variable wobble time period determined by a variable wobble time period selection signal produced by means b.

11. The control system of claim 1 wherein the calculating means calculations further includes a product lateral dimension parameter fed from an external signal source and used to select a range of wobble pattern data stored in said means.

12. The control system of claim 1 wherein the calculating means calculations further includes one or more other compensating parameters including product grade, product temperature and product shape, each fed from a respective external source, and one or more of said parameters used to modify the selected reel speed reference signal to compensate for respective undesireable effects.

13. The control system of claim 1 wherein the calculating means further calculates a separate reel drive current reference signal based on an incremental change in reel speed reference signal, total inertia equal to pouring reel inertia and variable coil inertia, and change in time since last calculation, and the controlling means also responds to the reel drive current reference signal to vary reel drive motor torque.

14. The coiling control system of claim 13 wherein the calculating means further calculates the variable coil inertia parameter as a function of, among others, calculated coiled product weight as it increases in the pouring reel, the calculating means further calculates the coiled product weight as a function of, among others, product length based on the product speed signal and time.

15. A coiling control system where a moving product is poured into a variable speed pouring reel to form layered coils therein, comprising:

a. means for generating a product speed signal;
b. means for calculating:
   1. a selectable segmented reel speed reference signal as a function of plural parameter signals and plural selection signals, the parameter signals including the product speed signal and one or more others including one of a plurality of segmented reel speed wobble patterns, wobble time period, coil outside dimension and coil inside dimension, and the corresponding reel speed, wobble pattern, wobble time period and coil inside and outside dimension selection signals, and
   2. a selectable segmented reel drive motor current reference signal as a function of an incremental change in selectable reel speed reference signal, total inertia equal to the pouring reel inertia and variable coil inertia, and change in time since last calculation;
c. means for producing the segmented reel speed wobble pattern selection signal and a corresponding one or more of the wobble time period, coil outside dimension and inside dimension selection signals; and
d. means for controlling pouring reel speed and drive motor torque in response to the combined selectable segmented reel speed and drive current reference signals, thereby maximizing pouring reel coil density under a variety of coiling situations.

16. A coiling control system where a moving product is directed through selectable coiler switch means into a selected variable speed pouring reel to form layered coils therein, comprising:

a. means for generating one or more coiler switch position signals:
b. means for controlling a corresponding one or more of the coiler switches in the switch means;
c. means for generating a ready-to-receive signal for each available pouring reel;
d. means for generating a product speed signal;
e. means for calculating:
   1. a corresponding number of coiler switch coiler signals for acting on the one or more coiler switch controllers in response to the coiler position signals,
   2. a pouring reel selection signal for effecting pouring reel selection in response to their ready-to-receive signals, and
   3. a reel speed reference signal for the selected pouring reel as a function of the product speed signal and at least one other parameter, and
f. means for controlling the selected pouring reel speed in response to the reel speed reference signal, thereby maximizing coil density in the selected pouring reel under a variety of coiling conditions.

17. The control system of claim 16 wherein the calculating means produces a reel drive motor current reference signal and at least one other parameter, and the pouring reel control means controls reel drive motor torque in response to the reel drive motor current reference signal.

18. In a coiling control method where a moving product is poured into a variable speed pouring reel to form layered coils therein, the method which comprises:

a. acquiring one or more product related parameter signals, including a product speed signal;
b. selecting one or more operating related parameter signals, including a reel speed wobble pattern selection signal;
c. calculating a selectable reel speed reference signal as a function of one or more product related parameter signals, including the product speed signal, and one or more operating related parameters including the reel speed wobble pattern selection signal; and
d. controlling pouring reel speed in response to the reel speed reference signal, thereby maximizing pouring reel coil density under a variety of coiling conditions.

19. The control method of claim 18 wherein the selecting step b. includes selecting a wobble time period parameter, and the calculating step c. calculations produce a reel speed reference signal having a segmented wobble pattern occurring in the selected wobble time period.

20. The control method of claim 18 wherein the selection step b. includes selecting a coil outside dimension parameter, and calculating step c. calculations include an independently variable coil outside dimension parameter determined by said selection.

21. The control method of claim 18 wherein the selection step b. includes selecting a coil inside dimension parameter, and calculating step c. calculations include an independently varaible coil inside dimension parameter determined by said selection.

22. The control method of claim 18 wherein the selection step b. includes selecting both coil outside and inside dimension parameters, and calculating step c. calculations include independently variable coil outside and inside dimension parameters determined by said selections.

23. The control method of claim 18 wherein the acquiring step a. includes acquiring a traversing parameter representing the head end of the moving product traversing a known distance in a known time period, and calculating step c. calculations include a product speed signal correction parameter determined by said acquisition.

24. The control method of claim 18 wherein the calculating step c. includes calculating a moving product length parameter as a function of the product speed signal and time.

25. The control method of claim 18 wherein the acquiring step a. includes acquiring a product lateral dimension parameter, and calculating step c. includes calculations using the product lateral dimension parameter to automatically select a range of wobble pattern data from storage.

26. The control method of claim 18 wherein the acquiring step a. includes acquiring one or more other product related parameters including product grade, product temperature and product shape, and calculating step c. calculations compensate the selected reel speed reference signal for one or more undesireable effects caused by said acquisitions.

27. The control method of claim 18 wherein the calculating step c. calculations include calculating a reel motor drive durrent reference signal as a function of incremental changes in reel speed reference signal, total intertia equal to pouring reel inertia and variable coil inertia, and change in time since last calculation, and controlling step d is modified to also respond to the reel motor drive current reference signal to vary reel drive motor torque.

28. The control method of claim 27 wherein the calculating step c. calculations include variable coil inertia parameter using parameters including calculated coiled product weight as it increases in the pouring reel, the calculating step c. calculations further include the coiled product weight parameter using parameters including product length based on the product speed signal and time.

29. A coiling control method where a moving product is poured into a variable speed pouring reel to form layered coils therein, the method which comprises:

a. acquiring one or more product related parameter signals, including a product speed signal;

b. selecting operating related parameter signals including a reel speed wobble pattern selecting signal and one or more others including wobble time period, coil outside and inside dimension, selection signals;

c. calculating:

1. a selectable reel speed reference signal as a function of one or more product parameter signals, including the product speed signal, and of one or more operating related parameter signals including the reel speed wobble pattern selection signals and corresonding one or more others including wobble time period, coil outside and inside dimension selection signals, and 2. a reel drive current reference signal as a function of incremental changes in reel speed reference signal, total inertia of pouring reel inertia and variable coil inertia, and change in time since last calculation; and d. controlling pouring reel speed and drive motor torque in response to the combined selectable reel speed and drive current reference signals, thereby maximizing pouring reel coil density under a variety of coiling situations.

30. A coiling control method where a moving product is directed through selectable coiler switch means into a selected variable speed pouring reel to form layered coils therein, the method which comprises:

a. acquiring one or more coiler switch position signals;

b. controlling a corresponding one or more of the coiler switches in response to respective coiler switch control signals;

c. generating a ready-to-receive signal for each available pouring reel;

d. generating a product speed signal;

e. calculating:

1. a corresponding number of coiler switch control signals for acting on the one or more coiler switch controllers in response to the coiler position signals;

2. a pouring reel selection signal for effecting pouring reel selection in response to their ready-to-receive signals, and 3. a reel speed reference signal for the selected pouring reel as a function of the product speed signal and at least one other parameter; and f. controlling the selected pouring reel speed in response to the reel speed reference signal, thereby maximizing coil density in the selected pouring reel under a variety of coiling conditions.

31. The control method of claim 30 wherein the calculating step c. includes calculations of sub-step .4 a reel drive motor current reference signal as a function of incremental changes in the reel speed reference signal and at least one other parameter, and step f. is mofiied to control reel drive motor torque in response to the reel drive motor current reference signal.

* * * * *

UNITED STATES PATENT AND TRADEMARK OFFICE

CERTIFICATE OF CORRECTION

PATENT NO. : 4,133,035

DATED : January 2, 1979

INVENTOR(S) : Joseph A. Grohowski et al.

It is certified that error appears in the above-identified patent and that said Letters Patent are hereby corrected as shown below:

Column 7, line 27, "cmmunications" should read

-- communications --.

Column 9, line 42, insert -- Table 1, Part 1, 2, 3 --, as shown on the attached sheets.

Signed and Sealed this

*Fourth* Day of *September 1979*

[SEAL]

*Attest:*

*Attesting Officer*

LUTRELLE F. PARKER

*Acting Commissioner of Patents and Trademarks*

TABLE 1 - SPEED WOBBLE PATTERN DATA
PART 1 - SPIRAL WITHOUT DWELL
REEL SIZE: O.D.=54.5", I.D.=38.5"

| Cold Bar Dimen. Range Inches | Hot Bar $D_E$ Inches | TMR | Segment A,B / C,D | $SL_A$ / $SL_C$ Feet | Equation A Coefficient / Equation C Coefficient $A_1,C_1$ | $A_2,C_2$ | $A_3,C_3$ | $SL_B$ / $SL_D$ Feet |
|---|---|---|---|---|---|---|---|---|
| 0.500-0.526 | 0.533 | 0.38258 | A,B | 168.48 | $0.15446 \times 10^{-2}$ | 0.0 | $0.25604 \times 10^{-7}$ | 0.0 |
| | | | C,D | 168.48 | $0.15466 \times 10^{-2}$ | 0.0 | $0.25604 \times 10^{-7}$ | 0.0 |
| 0.658-0.717 | 0.727 | 0.37080 | A,B | 119.83 | $0.21294 \times 10^{-2}$ | 0.0 | $0.67244 \times 10^{-7}$ | 0.0 |
| | | | C,D | 119.83 | $0.21294 \times 10^{-2}$ | 0.0 | $0.67244 \times 10^{-7}$ | 0.0 |
| 0.878-0.986 | 1.000 | 0.35443 | A,B | 83.383 | $0.29728 \times 10^{-2}$ | 0.0 | $1.8391 \times 10^{-7}$ | 0.0 |
| | | | C,D | 83.383 | $0.29728 \times 10^{-2}$ | 0.0 | $1.8391 \times 10^{-7}$ | 0.0 |
| 1.579-1.972 | 2.000 | 0.29630 | A,B | 34.950 | $0.62829 \times 10^{-2}$ | 0.0 | $17.974 \times 10^{-7}$ | 0.0 |
| | | | C,D | 34.950 | $0.62829 \times 10^{-2}$ | 0.0 | $17.974 \times 10^{-7}$ | 0.0 |

TABLE 1 - SPEED WOBBLE PATTERN DATA
PART 2 - SPIRAL WITH DWELL
REEL SIZE: O.D.=54.5", I.D.=38.5"

| Cold Bar Dimen. Range Inches | Hot Bar $D_E$ Inches | TMR | Segment A,B / C,D | $SL_A$ / $SL_C$ Feet | Equation A Coefficient / Equation C Coefficient $A_1,C_1$ | $A_2,C_2$ | $A_3,C_3$ | $SL_B$ / $SL_D$ Feet |
|---|---|---|---|---|---|---|---|---|
| 0.5000-0.526 | 0.533 | 0.38258 | A,B | 168.48 | $0.15446 \times 10^{-2}$ | 0.0 | $0.25604 \times 10^{-7}$ | 10.22 |
| | | | C,D | 168.48 | $0.15466 \times 10^{-2}$ | 0.0 | $0.25604 \times 10^{-7}$ | 14.13 |
| 0.658-0.717 | 0.727 | 0.37080 | A,B | 119.83 | $0.21294 \times 10^{-2}$ | 0.0 | $0.67244 \times 10^{-7}$ | 10.27 |
| | | | C,D | 119.83 | $0.21294 \times 10^{-2}$ | 0.0 | $0.67244 \times 10^{-7}$ | 14.08 |
| 0.878-0.956 | 1.000 | 0.35443 | A,B | 83.383 | $0.29728 \times 10^{-2}$ | 0.0 | $1.8391 \times 10^{-7}$ | 10.35 |
| | | | C,D | 83.383 | $0.29728 \times 10^{-2}$ | 0.0 | $1.8391 \times 10^{-7}$ | 14.01 |
| 1.579-1.972 | 2.000 | 0.29630 | A,B | 34.950 | $0.62829 \times 10^{-2}$ | 0.0 | $17.974 \times 10^{-7}$ | 10.60 |
| | | | C,D | 34.950 | $0.62829 \times 10^{-2}$ | 0.0 | $17.974 \times 10^{-7}$ | 13.74 |

TABLE 1 - SPEED WOBBLE PATTERN DATA
PART 3 - TRIANGULAR
REEL SIZE: O.D.=54.5", I.D.=38.5"

| Cold Bar Dimen. Range Inches | Hot Bar $D_E$ Inches | TMR | Segment A,B / C,D | $SL_A$ / $Sl_C$ Feet | Equation A Coefficient / Equation C Coefficient $A_1,C_1$ | $A_2,C_2$ | $A_3,C_3$ | $SL_B$ / $SL_D$ Feet |
|---|---|---|---|---|---|---|---|---|
| 0.500-0.526 | 0.533 | 0.38258 | A,B | 168.48 | $0.22708 \times 10^{-2}$ | 0.0 | 0.0 | 0.0 |
| | | | C,D | 168.48 | $0.22708 \times 10^{-2}$ | 0.0 | 0.0 | 0.0 |
| 0.658-0.717 | 0.727 | 0.37080 | A,B | 119.83 | $0.30944 \times 10^{-2}$ | 0.0 | 0.0 | 0.0 |
| | | | C,D | 119.83 | $0.30944 \times 10^{-2}$ | 0.0 | 0.0 | 0.0 |
| 0.878-0.986 | 1.000 | 0.35443 | A,B | 83.383 | $0.42506 \times 10^{-2}$ | 0.0 | 0.0 | 0.0 |
| | | | C,D | 83.383 | $0.42506 \times 10^{-2}$ | 0.0 | 0.0 | 0.0 |
| 1.579-1.972 | 2.000 | 0.29630 | A,B | 34.950 | $0.84778 \times 10^{-2}$ | 0.0 | 0.0 | 0.0 |
| | | | C,D | 34.950 | $0.84778 \times 10^{-2}$ | 0.0 | 0.0 | 0.0 |